US012623133B2

(12) United States Patent
Kakizawa

(10) Patent No.: US 12,623,133 B2
(45) Date of Patent: May 12, 2026

(54) BALL GAME PRACTICE APPARATUS

(71) Applicant: Akira Kakizawa, Phoenix, AZ (US)

(72) Inventor: Akira Kakizawa, Phoenix, AZ (US)

( * ) Notice: Subject to any disclaimer, the term of this patent is extended or adjusted under 35 U.S.C. 154(b) by 558 days.

(21) Appl. No.: 18/360,152

(22) Filed: Jul. 27, 2023

(65) Prior Publication Data

US 2024/0033601 A1 Feb. 1, 2024

Related U.S. Application Data

(60) Provisional application No. 63/393,545, filed on Jul. 29, 2022.

(51) Int. Cl.

| | |
|---|---|
| ***A63B 69/00*** | (2006.01) |
| ***A63B 63/00*** | (2006.01) |
| ***A63B 69/40*** | (2006.01) |
| ***A63B 71/02*** | (2006.01) |

(52) U.S. Cl.

CPC ..... *A63B 69/40* (2013.01); *A63B 63/00* (2013.01); *A63B 69/406* (2013.01); *A63B 71/022* (2013.01); *A63B 2063/001* (2013.01)

(58) Field of Classification Search

CPC ..... A63B 69/40; A63B 63/00; A63B 71/022; A63B 2063/001

USPC ..... 473/432, 431, 421

See application file for complete search history.

(56) References Cited

U.S. PATENT DOCUMENTS

| | | | | | |
|---|---|---|---|---|---|
| 2,087,575 | A * | 7/1937 | Littell | A63B 69/408 | 473/436 |
| 2,508,461 | A * | 5/1950 | Lemon | A63B 69/409 | 124/56 |
| 3,043,592 | A * | 7/1962 | Lohr | A63B 67/04 | 124/39 |
| 3,761,085 | A * | 9/1973 | Cook | A63B 69/406 | 473/436 |
| 3,911,888 | A * | 10/1975 | Horvath | A63B 69/409 | 124/53.5 |
| 3,918,711 | A | 11/1975 | Zak | | |
| 3,989,246 | A * | 11/1976 | Brown | A63B 47/025 | 124/53.5 |
| 4,002,336 | A * | 1/1977 | Beaver | A63B 69/409 | 124/56 |
| 4,074,905 | A * | 2/1978 | High | A63B 47/025 | 473/421 |
| 4,116,438 | A * | 9/1978 | Berliner | A63B 69/406 | 473/436 |

(Continued)

*Primary Examiner* — Mitra Aryanpour

(74) *Attorney, Agent, or Firm* — Parsons & Goltry, PLLC; Michael W. Goltry; Robert A. Parsons

(57) ABSTRACT

A ball game practice apparatus for receiving and delivering balls. The ball game practice apparatus including a backstop assembly having a framework supporting a flexible covering, the flexible covering including a back portion with an opening and a bottom portion shaped to funnel balls to an exit opening formed therein. A ball elevating device includes a base, a framework extending vertically from the base, an endless conveyor carried by the framework, and a feeder mechanism coupled to the endless conveyor, the feeder mechanism positioned under the exit opening of the bottom portion. A ball throwing device has a hopper and an outlet. The hopper is positioned to receive balls from the endless conveyor and deliver balls through the outlet and the opening.

20 Claims, 21 Drawing Sheets

(56) References Cited

U.S. PATENT DOCUMENTS

| | | | | | |
|---|---|---|---|---|---|
| 4,559,918 | A * | 12/1985 | Ballerin | A63B 69/406 | 124/78 |
| 4,735,405 | A * | 4/1988 | Marocco | A63B 69/409 | 124/53.5 |
| 4,841,945 | A * | 6/1989 | Braden | A63B 69/406 | 124/78 |
| 4,854,588 | A * | 8/1989 | Gatchel | A63B 69/40 | 124/78 |
| 4,974,843 | A | 12/1990 | Henningsson | | |
| 5,009,421 | A * | 4/1991 | Gatchel | A63B 69/40 | 473/436 |
| 5,335,905 | A * | 8/1994 | Newgarden, Jr. | A63B 69/40 | 473/462 |
| 5,566,936 | A * | 10/1996 | Newgarden | A63B 63/007 | 473/475 |
| 6,371,872 | B1 * | 4/2002 | Daley | A63B 69/406 | 473/460 |
| 9,480,894 | B2 | 11/2016 | Holland | | |
| 2015/0352426 | A1 * | 12/2015 | Romero | A63B 69/40 | 473/421 |
| 2017/0128801 | A1 | 5/2017 | Stirton et al. | | |
| 2024/0033601 | A1 * | 2/2024 | Kakizawa | A63B 71/022 | |

* cited by examiner

BALL GAME PRACTICE APPARATUS

CROSS-REFERENCE TO RELATED APPLICATIONS

This application claims the benefit of U.S. Provisional Patent Application No. 63/393,545, filed Jul. 29, 2022, incorporated herein by reference for all purposes.

FIELD OF THE INVENTION

The present invention relates to ball game practice apparatus configured to capture and deliver balls.

DESCRIPTION OF RELATED ART

Pickleball is a racket/paddle sport that combines elements of tennis, badminton, and ping-pong. It is played on a court the size of a badminton court, with a low net similar to tennis, using a paddle, a form of a racket, and a ball, a form of a wiffle ball in the nature of a plastic ball with holes. A player uses his paddle to hit the ball, commonly referred to as a pickleball, over the net to his opponent. The best way to score points in the game is to play at the non-volley line, seven feet from the net. The player hits the ball to advance from the baseline to their non-volley line, aiming for a successful drop shot into the opponent's non-volley zone between the net and the opponent's non-volley line. As the ball flies toward the opponent, the player runs toward their non-volley line to hit the ball. There are many rallies or ball exchanges at each team's non-volley line.

The greater a player's racket game skill level, the greater the chance of that player winning a game. Typically, a player improves his skills through practice and repetition. He can enhance his ball-playing skills by hitting hundreds of balls with his racket continuously for each skill, a form of training many players want to perform at home. Currently, the player uses a ball-throwing machine to hit tens of balls at a court, then spends dozens of times longer picking them up and returning them to the machine. Or the player hires a coach for practice at a considerable expense. This invention eliminates this extra time, work, and cost.

It would be highly advantageous, therefore, to remedy the foregoing and other deficiencies inherent in the prior art by providing a ball game practice apparatus configured to retrieve and deliver balls repeatedly for allowing a player to practice his racket/paddle sport skills.

SUMMARY OF THE INVENTION

Briefly, to achieve the desired objects and advantages of the instant invention in accordance with a preferred embodiment provided is a ball game practice apparatus. The ball game practice apparatus includes a backstop assembly a ball elevating device and a ball throwing device. The backstop assembly includes a framework supporting a flexible covering having a back portion, a bottom portion, an exit opening, and a delivery opening. The bottom portion is shaped to funnel balls carried thereon to the exit opening formed therein. The back portion has the delivery opening. The ball elevating device includes a base, a framework extending vertically from the base, an endless conveyor carried by the framework, and a feeder mechanism coupled to the endless conveyor. The exit opening is open to the feeder mechanism positioned under the exit opening of the bottom portion. The ball throwing device has a hopper and an outlet. The hopper is positioned to receive balls from the endless conveyor and deliver balls through the outlet and the delivery opening. The back portion is attached directly to the ball throwing device, securing the delivery opening registered with the outlet. In a particular embodiment, the back portion has a reinforcing collar encircling the delivery opening and attached directly to the ball throwing device, securing the delivery opening registered with the outlet.

In another aspect, the endless conveyor of the ball elevating device includes a first double spindle rotatably carried by a first spindle bracket coupled to a bottom portion of the framework of the ball elevating device. The double spindle spaced apart from the base to form a gap therebetween. A motor is coupled to the first double spindle, the motor movable between an off configuration and an on configuration, in the on configuration, the motor rotating the first double spindle. A second double spindle is rotatably carried by a second spindle bracket coupled to a top portion of the framework of the ball elevating device. A pair of endless belts is coupled between the first double spindle and the second double spindle, the pair of endless belts moving vertically with the motor in the on configuration. A plurality of carrier members are carried by the pair of endless belts. Each carrier member of the plurality of carrier members is coupled to the pair of endless belts for movement therewith.

BRIEF DESCRIPTION OF THE DRAWINGS

Specific objects and advantages of the invention will become apparent to those skilled in the art from the following detailed description of illustrative embodiments thereof, taken in conjunction with the drawings in which.

DETAILED DESCRIPTION

Figure 1:
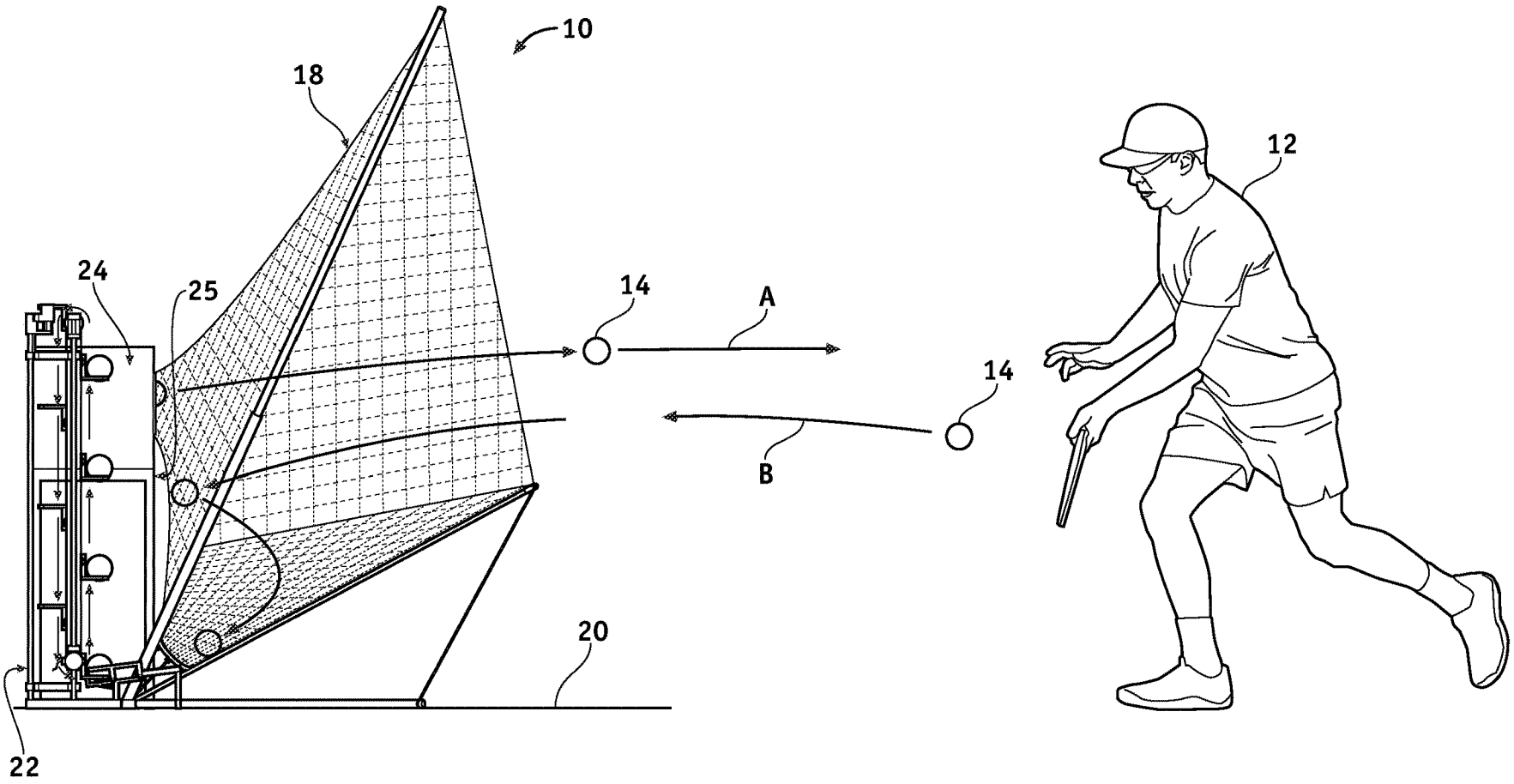
FIG. 1 is a perspective view of a ball game practice apparatus according to the present invention, in use.

Turning to the drawings in which like reference characters indicate corresponding elements throughout the several views, attention is directed to FIG. 1, illustrating a ball game practice apparatus generally designated 10. Apparatus 10 is useful by an individual player 12 to practice repeatedly hitting balls 14 repeatedly delivered from the apparatus 10 along arrowed line A, in a proper direction and height to mimic hitting balls during an actual game of a racket sport on a court as indicated by arrowed line B. In this example, the balls 14 are pickleballs and the apparatus 10 is shown used by the individual player 12 to practice repeatedly hitting balls 14 repeatedly delivered from the apparatus 10 along arrowed line A, in the proper direction and height to mimic hitting balls during an actual game of pickleball on a pickleball court as indicated by arrowed line B. The use of apparatus 10 permits a user to practice the skills used for a racket sport, pickleball in this example, to be practiced outside the court, such as at home. It will be understood by one of ordinary skill in the art that while apparatus 10 is described for use with the game of pickleball in the following description, it can be dimensioned to be used in any racket sport, namely, any game in which players use a racket/paddle to hit a ball, such as tennis and the like.

In this preferred embodiment, apparatus 10 includes a backstop assembly 18 positioned on a generally flat surface 20, a ball elevating device 22 positioned on flat surface 20 behind backstop assembly 18, and a ball throwing device 24. In this example, device 24 is supported at an elevated location above flat surface 20 by and atop a support, in this example a stand 25, positioned on and extending upright from flat surface 20 adjacent to device 22 to the device 24 the stand 25 supports. This elevated positioning of the device 24 over the flat surface 20 allows it to relate to the backstop assembly 18 as described herein. Device 24 is a standard and well-known electro-mechanical device that delivers, i.e., throws or tosses, balls 14, in this implementation through backstop assembly 18 toward player 12 and device 22 receives balls 14 delivered by player 12 into backstop assembly 18 and conveys them to the device 24, as will be described presently.

Figure 2:
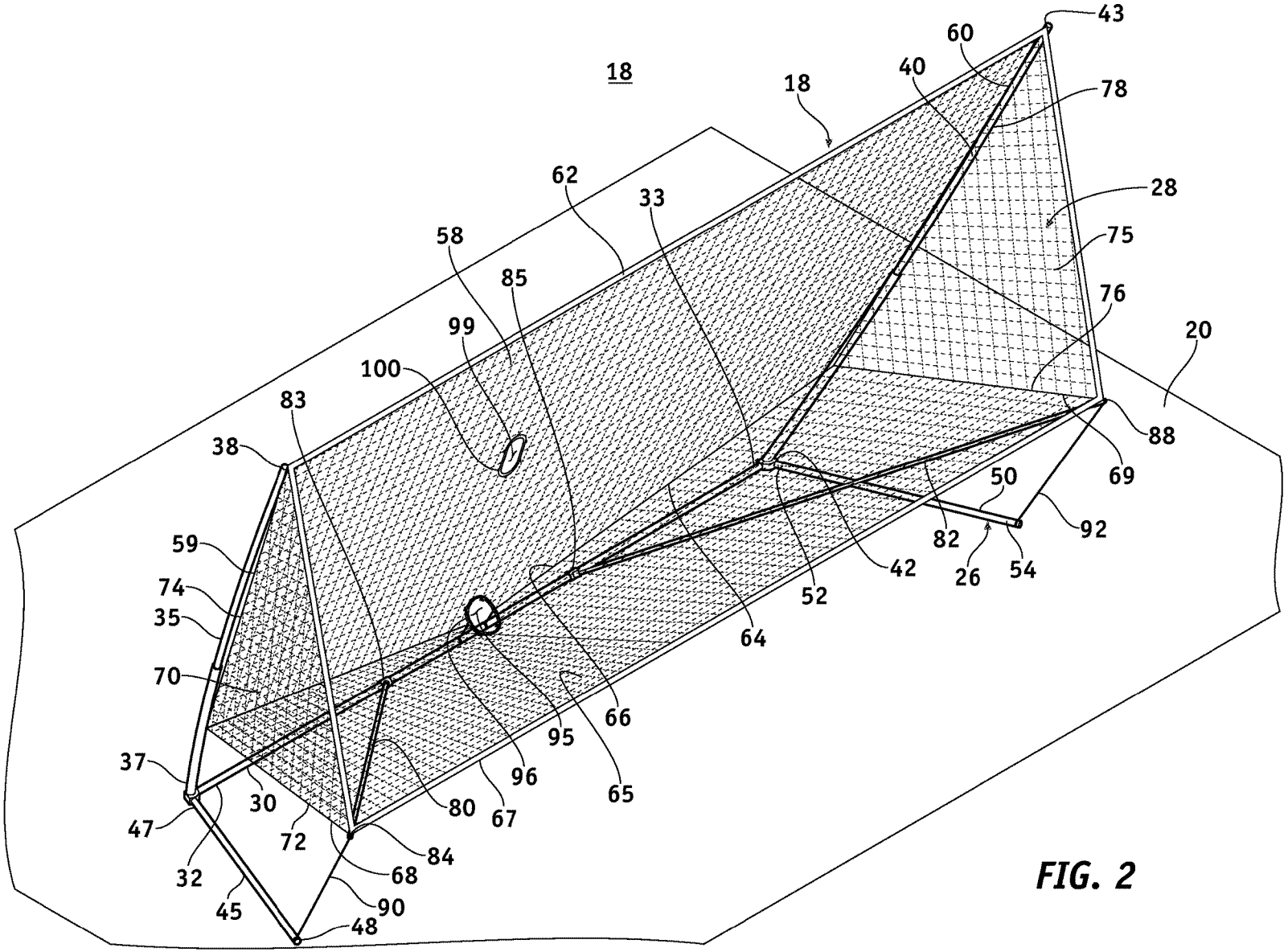
FIG. 2 is a perspective view of a backstop assembly according to the present invention.
Figure 3:
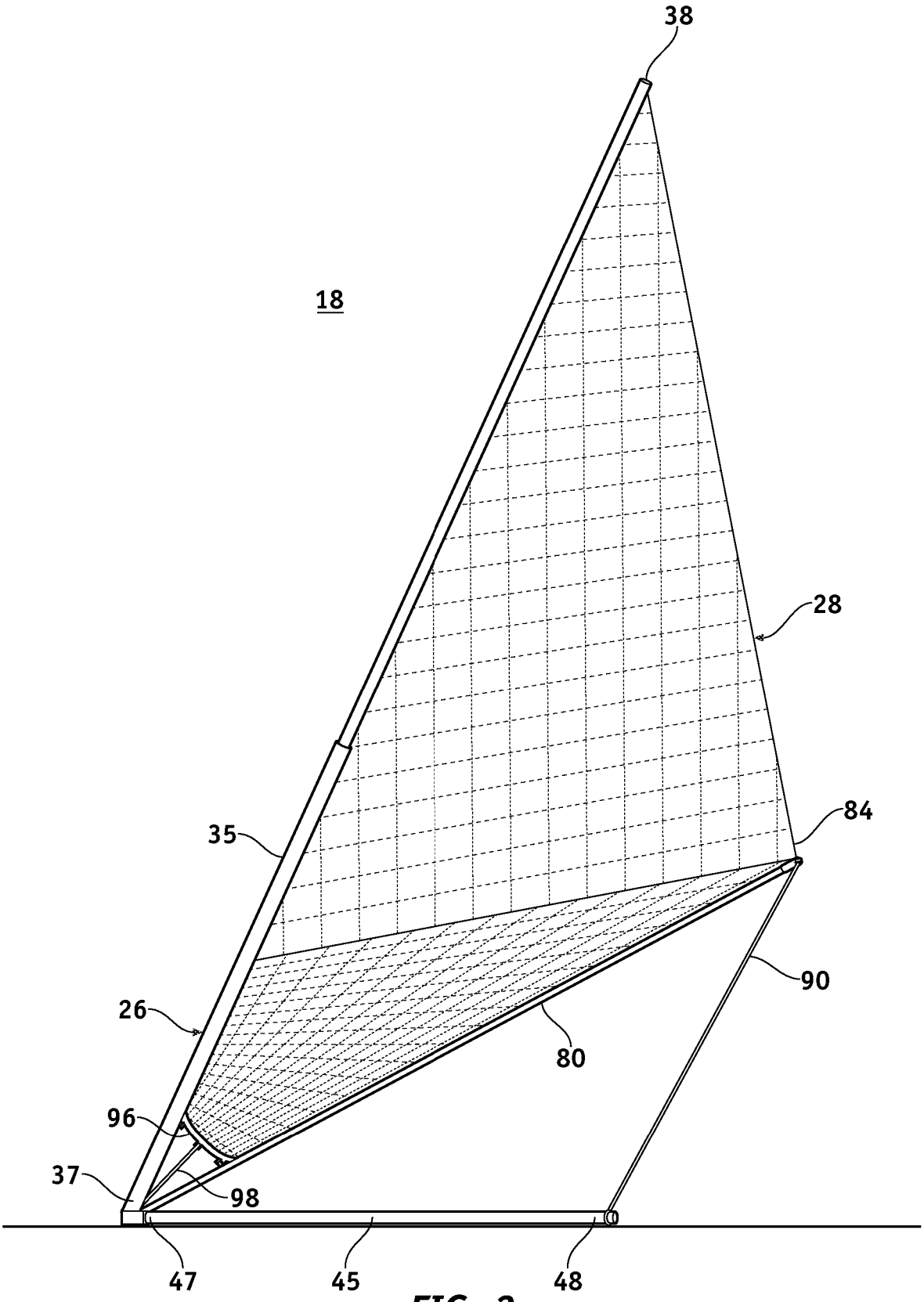
FIG. 3 is a side view of the backstop assembly of FIG. 2.

In FIGS. 2 and 3, backstop assembly 18, used for stopping and collecting balls 14 and directing or otherwise conveying them to the device 22, includes a framework 26 and a flexible covering 28. Framework 26 includes a base pole 30 having an end 32 and an opposing end 33. Base pole 30 is a generally rigid rod which can be a solid integral element or made up of segments to allow collapsibility for simplifying portability such as by telescoping or folding as is well known in tent pole members. Base pole 30 is positioned on flat surface 20 extending perpendicularly to the position of player 12 and the deliver and return directions of ball 14 as indicated by arrowed lines A and B (FIG. 1). An upright pole 35 has a proximal end 37 coupled to and extending from end 32 of base pole 30 and a distal end 38. Proximal end 37 is removable and/or movably coupled to end 32 in a well know manner and will not be discussed in detail herein. Another upright pole 40 has a proximal end 42 coupled to and extending from end 33 of base pole 30 and a distal end 43. Proximal end 42 is removable and/or movably coupled to end 33 in a well know manner and will not be discussed in detail herein. Upright poles 35 and 40 are preferably angled forwardly toward player 12 (FIG. 1) for reasons which will be described presently. In the following description, forward is a direction toward player 12 of FIG. 1 and rearward is a direction directly away from player 12 of FIG. 1. A stabilizing pole 45 has a proximal end 47 coupled to and extending from end 32 of base pole 30 and a distal end 48. Proximal end 47 is removable and/or movably coupled to end 32 in a well know manner and will not be discussed in detail herein. Stabilizing pole 45 extends outwardly, overlying and supported by flat surface 20, in a forward direction generally toward player 12 (FIG. 1) and preferably at an obtuse angle with respect to base pole 30 and less than a perpendicular angle with respect to upright pole 35 due to its forward lean. A stabilizing pole 50 has a proximal end 52 coupled to and extending from end 33 of base pole 30 and a distal end 54. Proximal end 52 is removable and/or movably coupled to end 33 in a well know manner and will not be discussed in detail herein. Stabilizing pole 50 extends outwardly, overlying and supported by flat surface 20, in a forward direction generally toward player 12 (FIG. 1) and preferably at an obtuse angle with respect to base pole 30 and less than a perpendicular angle with respect to upright pole 40 due to its forward lean.

Figure 4:
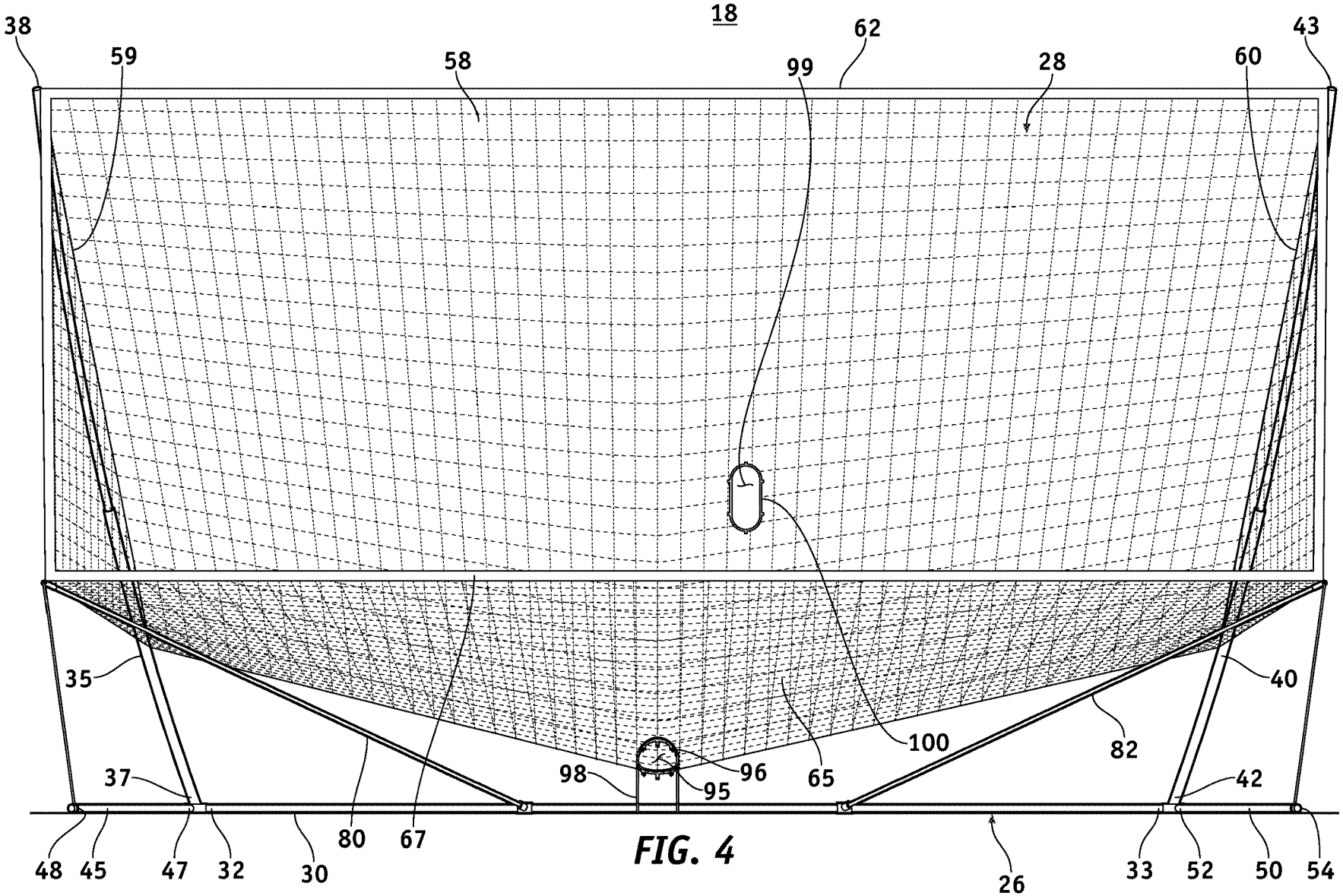
FIG. 4 is a front view of the backstop assembly of FIG. 2.

With continued reference to FIGS. 2 and 3, and additional reference to FIG. 4, framework 26 carries flexible covering 28. Flexible covering 28, formed with openings 95 and 99 each configured to allow balls to pass therethrough sequentially or otherwise one at a time, can be substantially any material which will absorb the energy of ball 14 hit into it, such as cloth, plastic sheeting and the like. Opening 95 is an exit opening of flexible covering 28. Opening 99 is a delivery opening of flexible covering 28. In the preferred embodiment, flexible covering 28 is fabricated of netting material allowing it to be seen through and wind to pass through while stopping ball 14. Flexible covering 28 includes a back portion 58, having opposing side edges 59 and 60, a top edge 62 and a bottom edge 64 extending therebetween. Side edge 59 of back portion 58 is coupled to upright member 35 from proximate to distal end 38 to a position proximate to but spaced apart from proximal end 37. Side edge 60 of back portion 58 is coupled to upright member 40 from proximate to distal end 43 to a position proximate to but spaced apart from proximal end 42, with back portion 58 stretched between upright member 35 and upright member 40. The forward lean of upright members 38 and 40 give a corresponding forward lean to back portion 58, directing downwardly those balls 14 contacting back portion 58. Flexible covering 28 further includes a bottom portion 65 having a back edge 66, a front edge 67 and opposing side edges 68 and 69. Back edge 66 is coupled to bottom edge 64 of back portion 58. A side portion 70 has a bottom edge 72 and a side edge 74. Bottom edge 72 is coupled to side edge 68 of bottom portion 65 and side edge 74 is coupled to side edge 59 of back portion 58 with side portion 70 extending therebetween. A side portion 75 has a bottom edge 76 and a side edge 78. Bottom edge 76 is coupled to side edge 69 of bottom portion 65 and side edge 78 is coupled to side edge 60 of back portion 58 with side portion 75 extending therebetween. Bottom portion 65 and side portions 70 and 75 are held in a forwardly extended position by expander poles 80 and 82 such that front edge 67 of bottom portion 65 is higher than back edge 66. Expander pole 80 extends from a point 83 on base pole 30 spaced apart from end 32 to an end 84 coupled to the junction of the front edge 67 and side edge 68 of bottom portion 65, expanding and holding bottom portion 65 and side portion 70 stretched in a forward direction toward player 12 (FIG. 1). Expander pole 82 extends from a point 85 on base pole 30 spaced apart from end 33 to an end 88 coupled to the junction of the front edge 67 and side edge 69 of bottom portion 65, expanding and holding bottom portion 65 and side portion 75 stretched in a forward direction toward player 12 (FIG. 1). A tension element 90 is coupled between distal end 48 of stabilizing pole 45 and end 84 of expander pole 80 and a tension element 92 is coupled between distal end 54 of stabilizing pole 50 and end 88 of expander pole 82, pulling bottom portion 65 downwardly to provide tension throughout flexible covering 28.

Backstop assembly 18 receives balls at velocity and automatically directs the balls from back portion 58 to bottom portion 65 and its opening 95, the exit opening of the bottom portion 65 of the flexible covering 28. Once dropped onto bottom portion 65, the balls pass to opening 95. Opening 95 is sized to allow balls to exit therethrough and positioned adjacent to back edge 66, preferably centrally between side edge 72 and side edge 76. Opening 95 is strengthened by an annular reinforcing member 96 carried around a perimeter edge of the opening 95, providing a strong perimetric edge. Annular reinforcing member 96 carried by the flexible covering 28 encircles the opening 95 and can be fabricated of many different materials such as leather, fabric, plastic and the like, and affixed using different methods, such as adhesives, stitching, clips and the like.

To ensure that balls move to opening 95, tension members 98 extend from annular reinforcing member 96 and are coupled to base pole 30 under tension, pulling and tensioning bottom portion 65 downwardly at the central back edge to create a funnel shape in bottom portion 65 centered on opening 95. Thus, any balls that drop onto bottom portion 65 roll through the funnel shape to and through annular reinforcing member 96 and opening 95. To prevent distortion of either annular reinforcing member 96 or opening 95, to prevent obstruction thereof and to help form the funnel shape, tension members 98 extend from opposing sides of annular reinforcing member 96 to base pole 30, constantly pulling the back portion 58 and the bottom portion 65 downwardly to provide tension throughout flexible covering 28.

Figure 5:
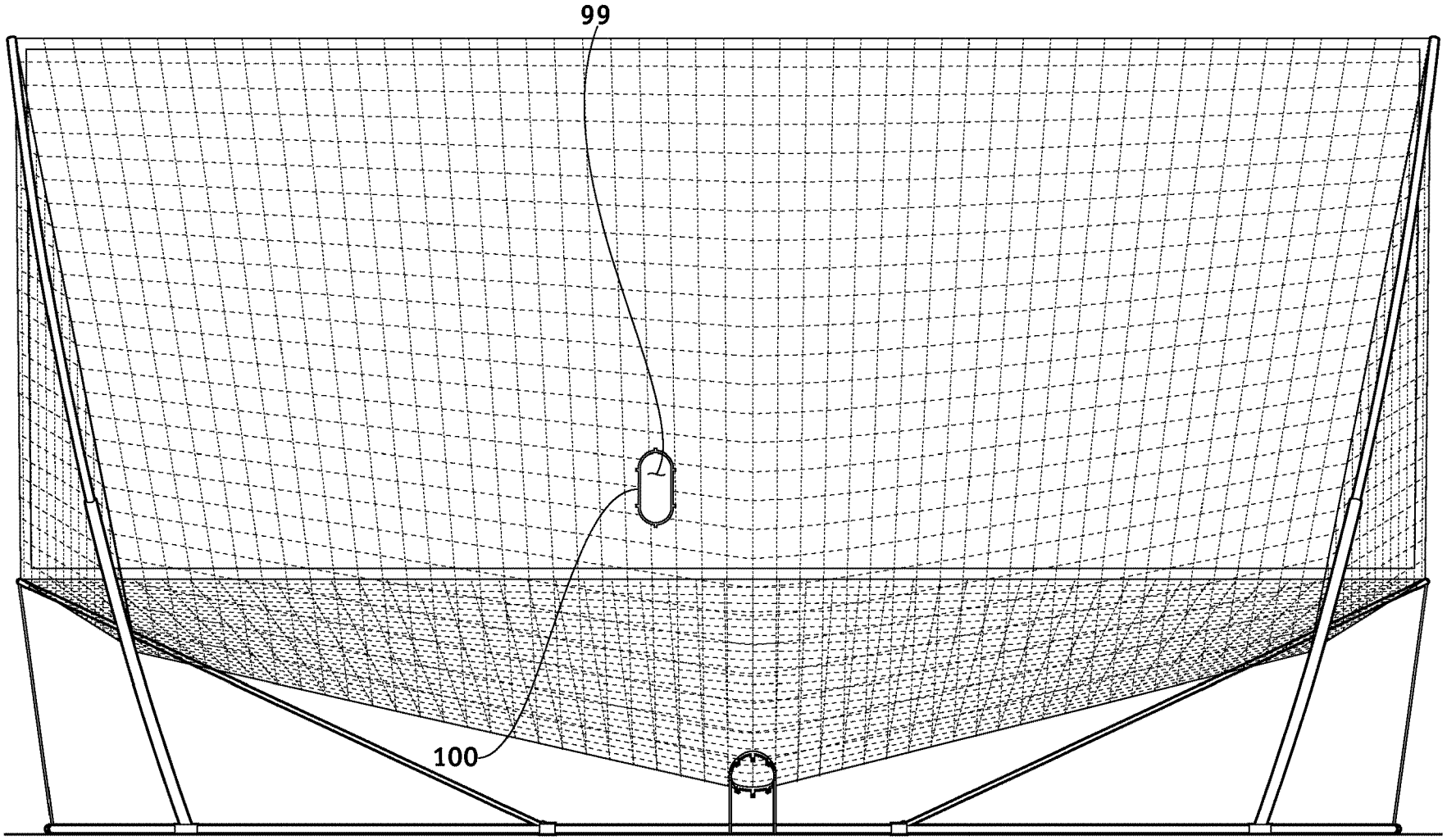
FIG. 5 is a front view of another embodiment of the backstop assembly.

Referring to FIGS. 2 and 4-5, backstop assembly 18 allows passage of balls through back portion 58 of flexible covering 28. This is achieved in part by the inclusion of opening 99 formed in back portion 58 of flexible covering 28. Opening 99 through back portion 58 is above opening 95 and bottom portion 65 and between side portions 70 and 75. A reinforcing collar 100 carried by back portion 58 around a perimeter edge of opening 99 provides a strong perimetric edge. Reinforcing collar 100 encircles the opening 99 and can be fabricated of many different materials such as leather, fabric, plastic and the like, and affixed using different methods, such as adhesives, stitching, clips and the like. As will be described presently, opening 99 need only be large enough to allow passage of a ball therethrough and not so large as to easily permit unintentional passage of balls from the front toward player 12 (FIG. 1). Opening 99 is shown to the right of center in FIG. 4, but can be positioned in other location as desired. FIG. 5 illustrates opening 99 positioned to the left of center for illustrative purposes. It will be understood that while backstop assembly 18 is preferably moveable between a collapsed configuration for storage and an expanded configuration for use, a rigid or permanent backstop assembly is also contemplated.

Figure 6:
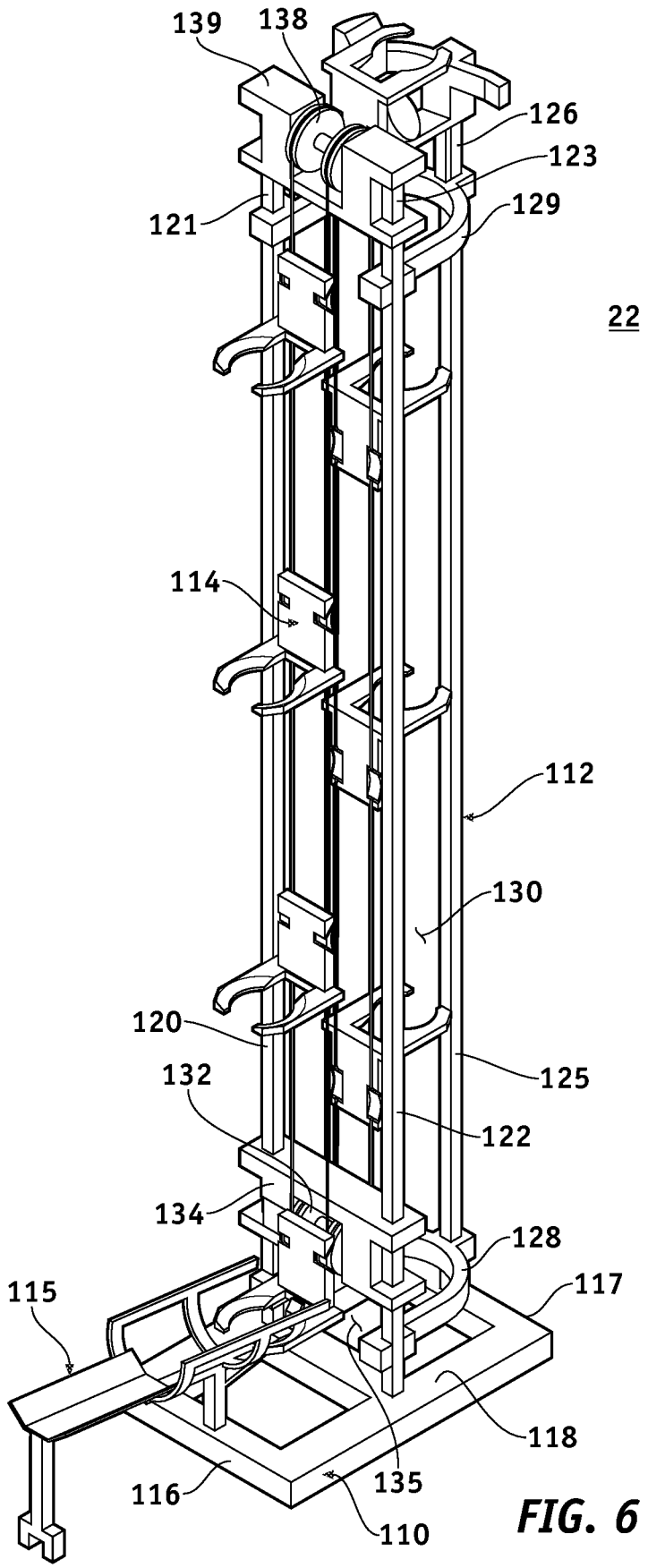
FIG. 6 is a perspective right side view a ball elevating device according to the present invention.
Figure 7:
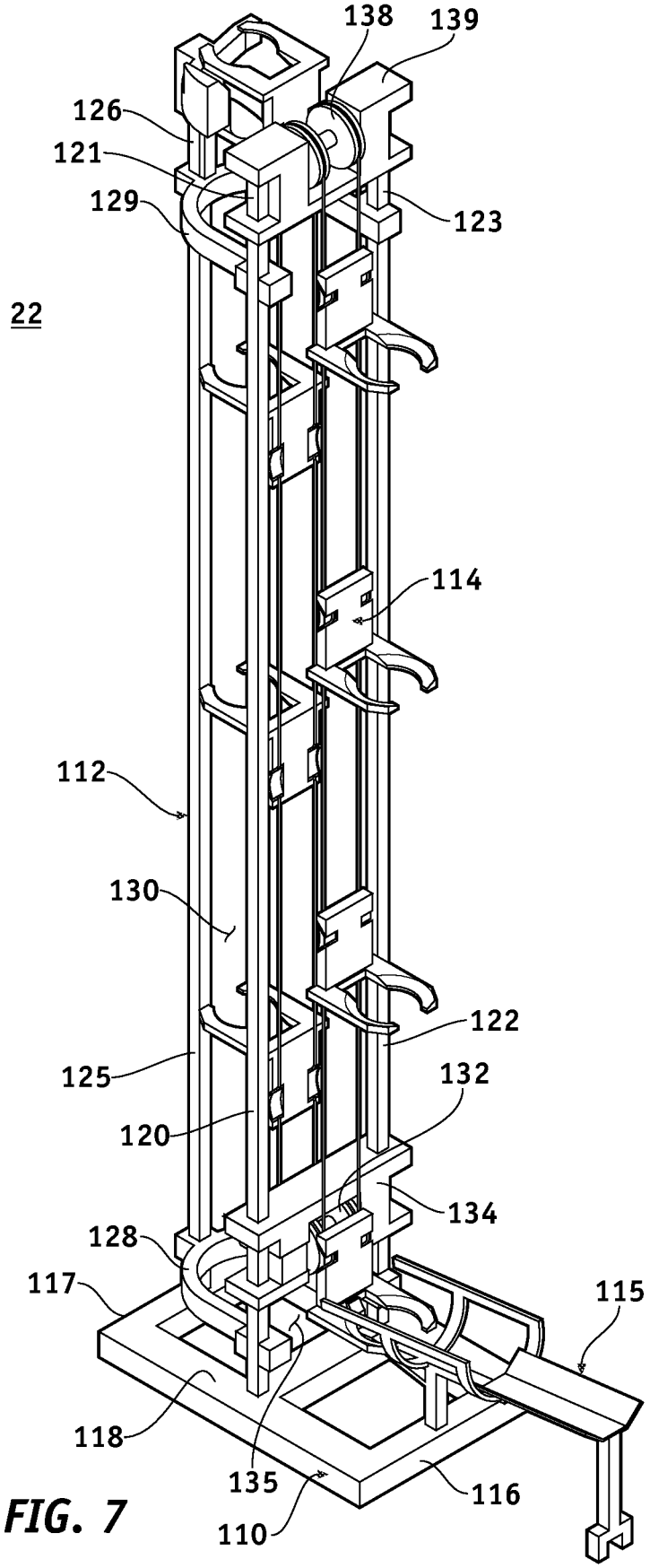
FIG. 7 is a perspective left side view the ball elevating device of FIG. 6.

Turning to FIGS. 6 and 7, device 22 of apparatus 10 includes a base 110 supporting a framework 112. Framework 112 carries an endless conveyor 114 and is coupled to a feeder mechanism 115. Base 110 has a forward edge 116, a rearward edge 117 and a top surface 118. Framework 112 extends upwardly from top surface 118 of base 110 at the bottom of the framework 112 and includes a post or column 120 terminating in an end 121 at the top of the framework 112, a post or column 122 terminating in an end 123 at the top of the framework 112 and a post or column 125 terminating in an end 126 at the top of the framework 112, each extending upwardly from base 110. Columns 120 and 122 extend from base 110 intermediate forward edge 116 and rearward edge 117 and from opposing sides of base 110. Column 125 extends from base 110 spaced rearwardly from columns 120 and 122 toward rearward edge 117 and positioned therebetween in a triangular disposition. A U-shaped bracket 128 is positioned in engagement with and coupling column 120, column 122, and column 125 proximate to base 110 and a U-shaped bracket 129 is positioned in engagement with and coupling column 120, column 122 and column 125 proximate to ends 121, 123, and 126. U-shaped brackets 128 and 129 inherently strengthen or otherwise reinforce framework 112. The framework 112 and its U-shaped brackets 128 and 129 cooperate to define a central pathway or volume 130 extending upright vertically from base 110 past ends 121, 123, and 126.

Figure 8:
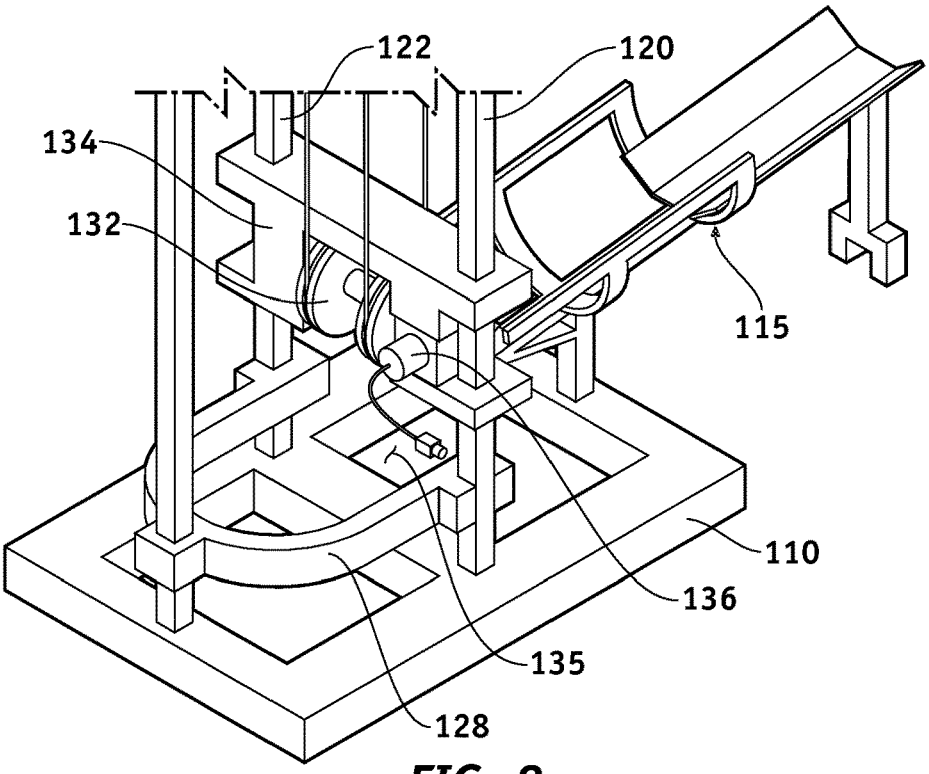
FIG. 8 is an enlarged partial left rear perspective view of a bottom of the ball elevating device.
Figure 9:
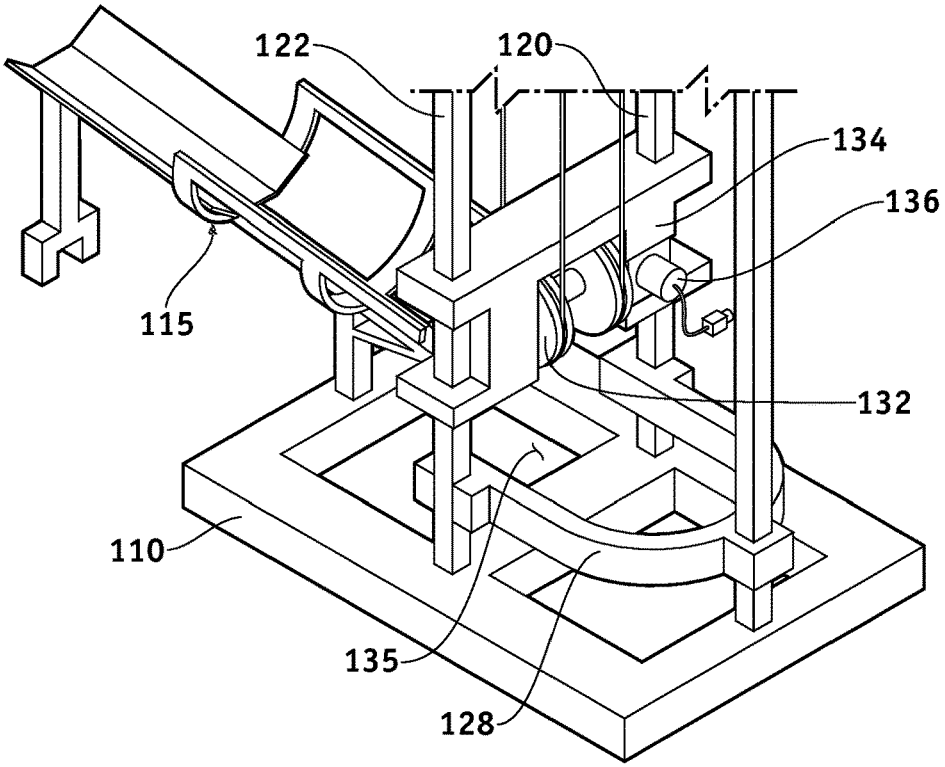
FIG. 9 is an enlarged partial right rear perspective view of a bottom of the ball elevating device.
Figure 12:
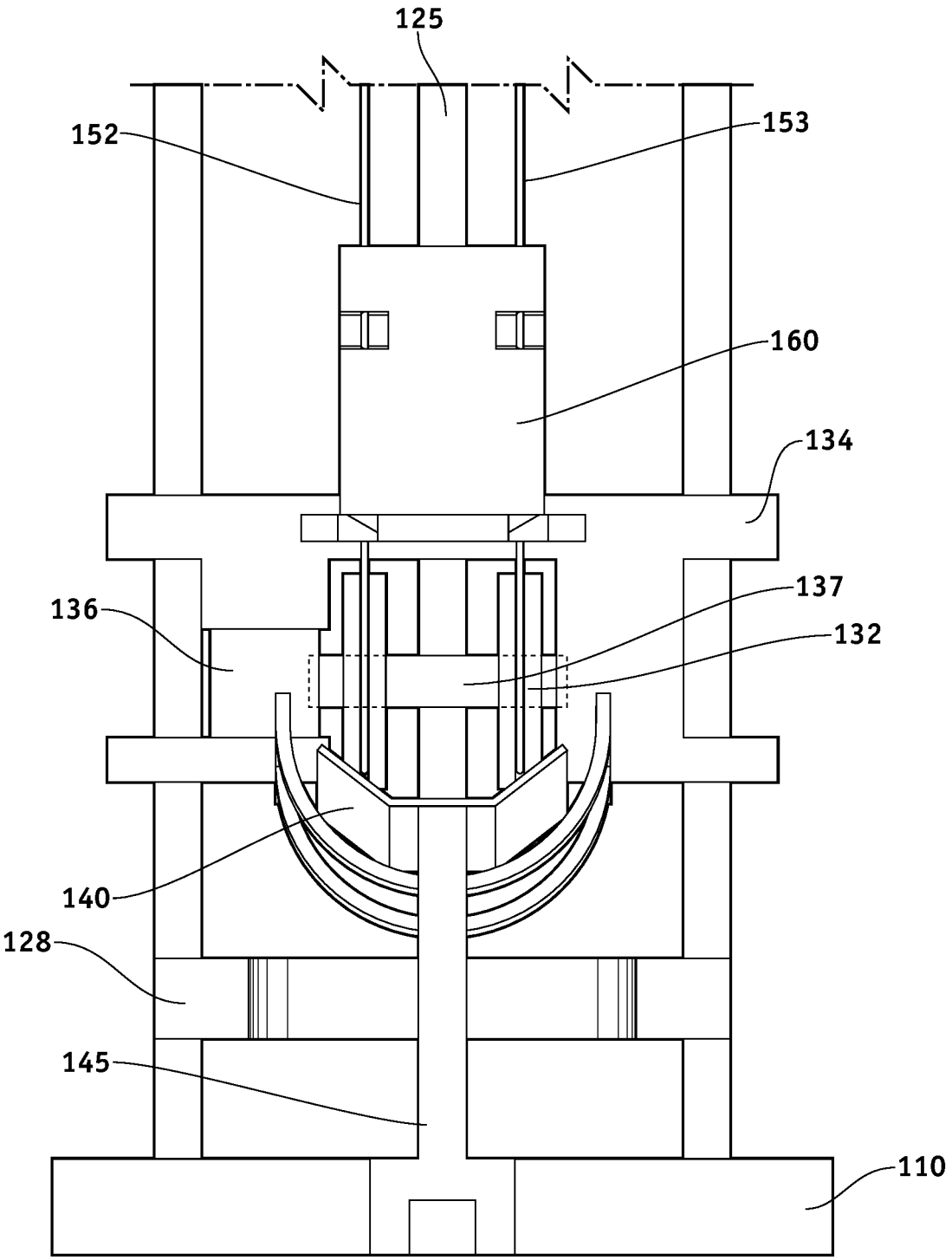
FIG. 12 is a front view of the lower portion of the ball elevating device.
Figure 13:
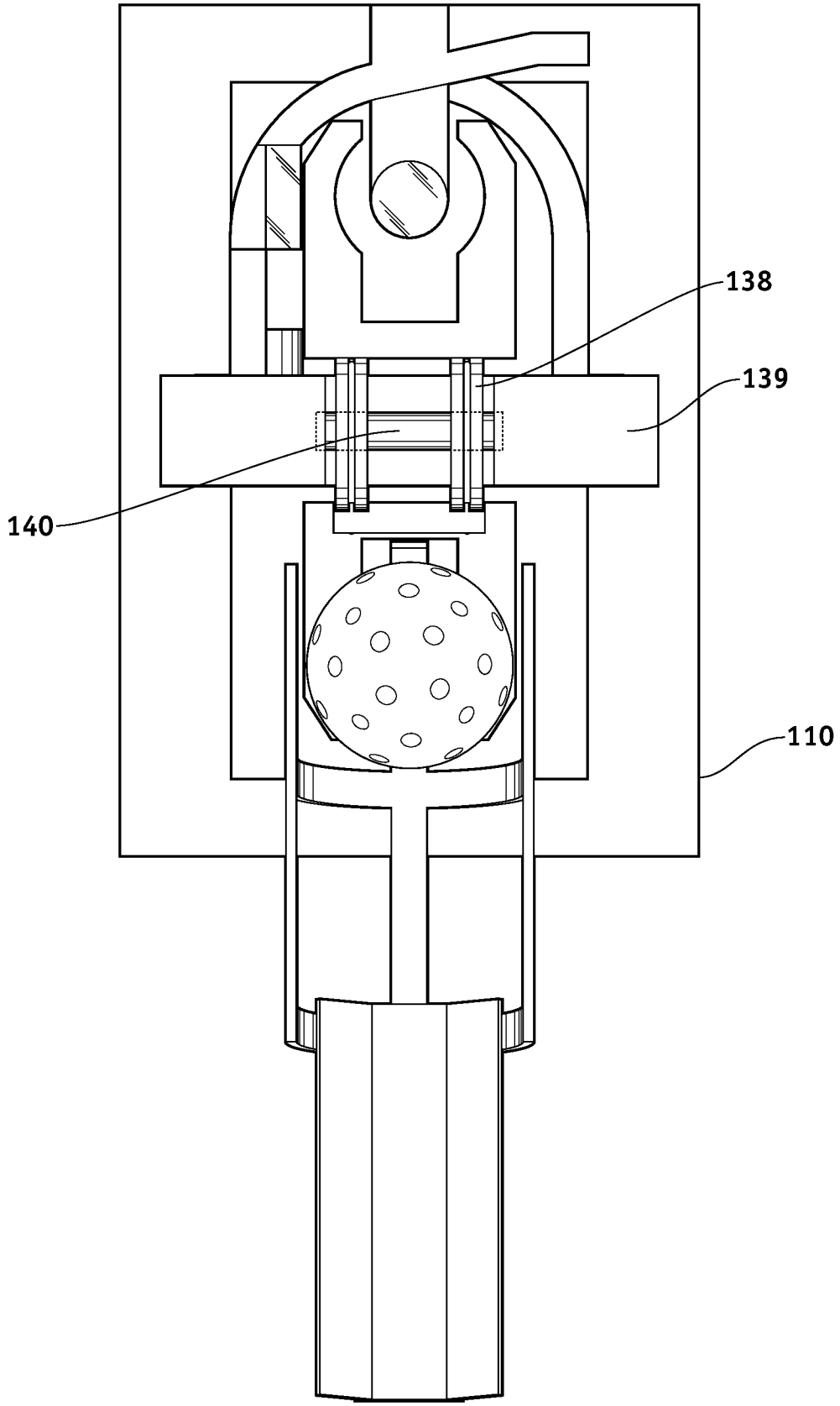
FIG. 13 is a top view of the ball elevating device.

With additional reference to FIGS. 8 and 9, endless conveyor 114 includes a double spindle 132 rotatably carried by a spindle bracket 134 coupled to and extending between columns 120 and 122. spindle bracket 134 is positioned above U-shaped bracket 128 and spaced apart from base 110 to form a gap 135 defined by base 110 on the bottom, spindle bracket 134 on the top, and columns 120 and 122 to the sides. Double spindle 132 is rotated by a motor 136 (preferably electric) movable between an off configuration and an on configuration. The motor 136 is powered by a power source, such as a portable battery power source. The motor 136 is off when unpowered and on when powered by the power source. The battery power source can have an ON/OFF switch for activating the motor 136 when the switch is in its ON position and deactivating the motor 136 when the switch is in its OFF position. With momentary reference to FIG. 12, Double spindle 132 includes an axle 137 journaled in opposing sides of spindle bracket 134. In the on configuration, motor 136 rotates double spindle 132 for purposes which will described presently. With additional reference to FIG. 10, a double spindle 138 is rotatably carried by a spindle bracket 139 coupled to and extending between columns 120 and 122. Spindle bracket 139 is positioned above U-shaped bracket 129 proximate to ends 121 and 123 of columns 120 and 122, respectively. With momentary reference to FIG. 13, double spindle 138 includes an axle 140 journaled in opposing sides of spindle bracket 139.

Figure 10:
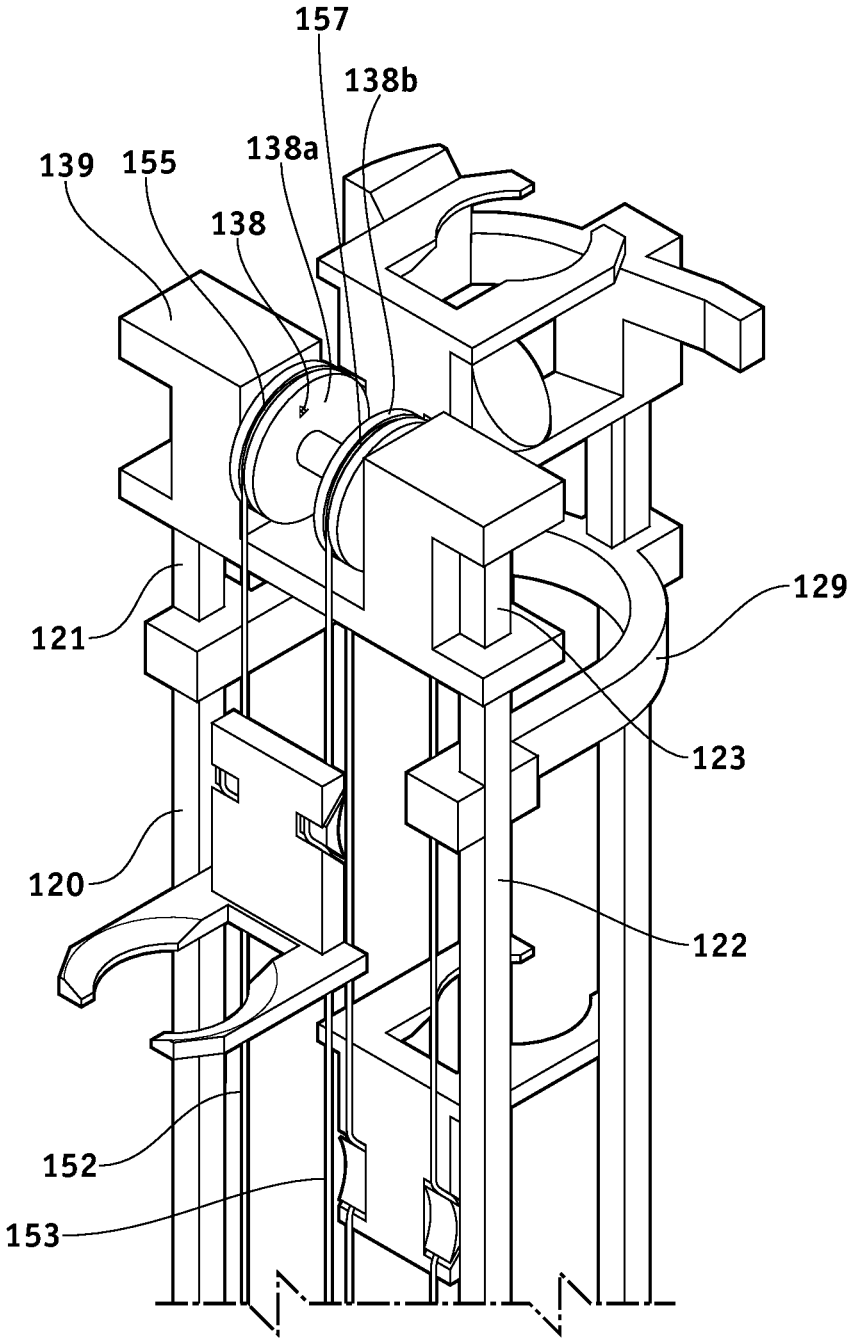
FIG. 10 is an enlarged partial perspective view of a top portion of the ball elevating device.
Figure 11:
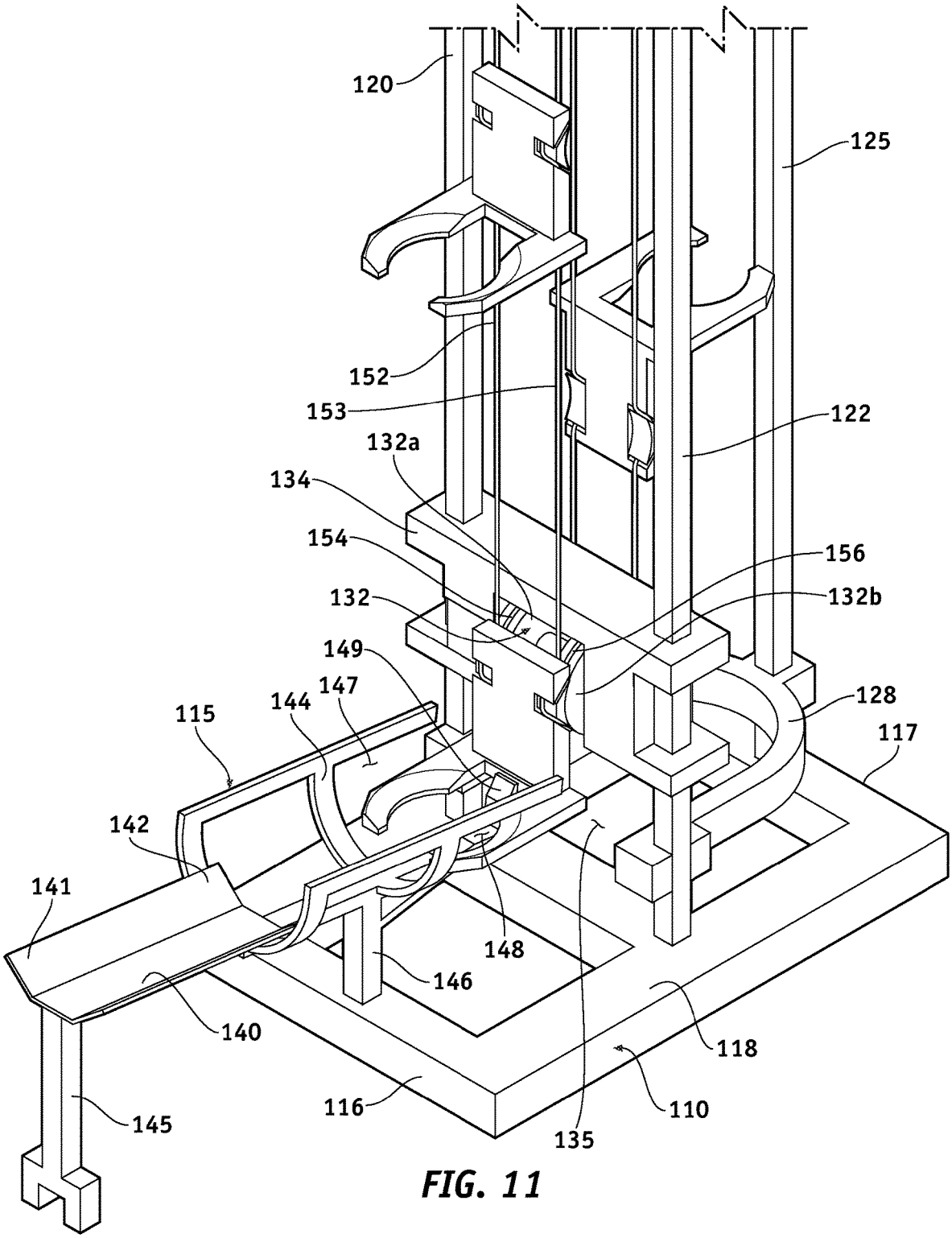
FIG. 11 is an enlarged partial right front perspective view of a bottom of the ball elevating device.

Referring to FIGS. 6 and 7, with additional reference to FIGS. 10 and 11, endless conveyor 114 includes parallel endless belts 152 and 153. Endless belt 152 is suitably tensioned and passes around and is received by a groove 154 formed in a spindle 132*a* of a double spindle 132 proximate to column 120 and proximate to the bottom of the framework 112, passes upward along its elevating run through volume 130 from spindle 132*a* to a spindle 138*a* of a double spindle 138 proximate to column 120 and proximate to the top of the framework 112, passes around and is received by a groove 155 formed in spindle 138*a* and passes back downward along its descending run through volume 130 from spindle 138*a* to spindle 132*a* of double spindle 132. Endless belt 153 is suitably tensioned and passes around and is received by a groove 156 formed in a spindle 132*b* of double spindle 132 proximate to column 122, passes upward along its elevating run through volume 130 from spindle 132*b* to a spindle 138*b* of double spindle 138 proximate to column 122, passes around and is received by a groove 157 formed in spindle 138*b* and passes back downward along its descending run through volume 130 from spindle 138*b* to spindle 132*b* of double spindle 132. Endless belts 152 and 153 are flexible cords in the preferred embodiment, but can be bands, wires, chains, ropes or any other flexible material from which a continuous loop can be formed. Double spindle 132 is rotated by motor 136, moving endless belts 152 and 153 frictionally engaging the grooves in spindles 132*a*, 132*b*, 138*a*, 138*b*. Rotation of double spindle 132 concurrently moves double spindle 138 through the movement of endless belts 152 and 153.

Referring to FIG. 11, feeder mechanism 115 includes a transfer ramp 140 having a high end 141 and inclined downwardly to a low end 142. Low end 142 engages a positioning cradle 144. Transfer ramp 140 is supported by a brace 145 which rests on surface 20 and supports raised end 141 at a height which will described in more detail later. Positioning cradle 144 is supported by a brace 146 extending from proximate to front edge 116 of base 110 at a level below raised end 141. Positioning cradle 144 is located between columns 120 and 122, proximate to spindle bracket 134 and adjacent to a top portion of gap 135. Positioning cradle 144 includes a cut-out 147 and 148 on opposing sides of a stop member 149.

Figure 14:
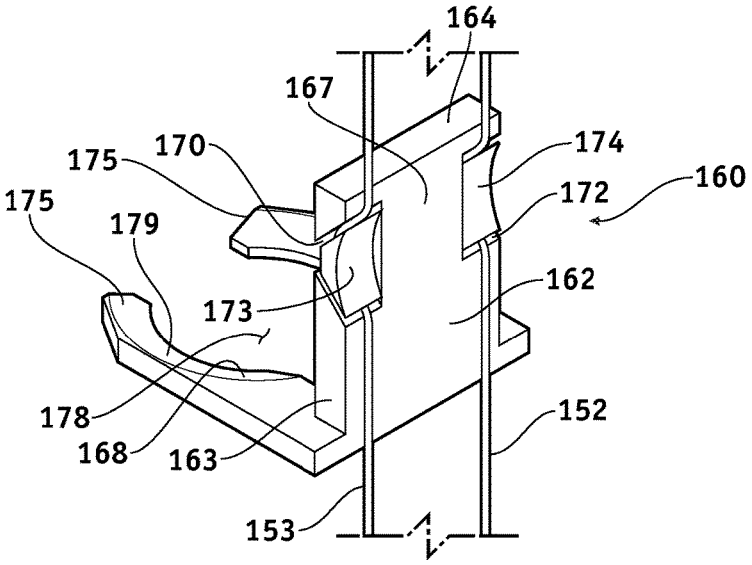
FIG. 14 is an enlarged rear perspective view of a carrier member.
Figure 15:
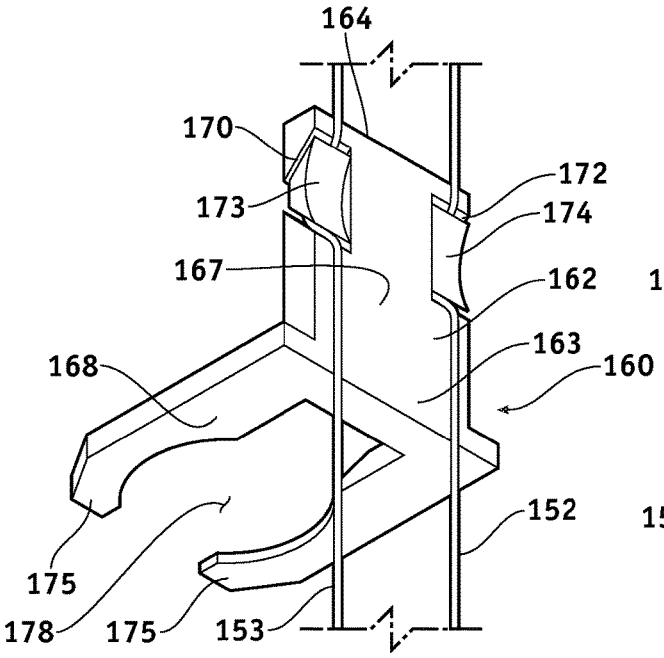
FIG. 15 is an enlarged upwardly directed rear perspective view of a carrier member.
Figure 16:
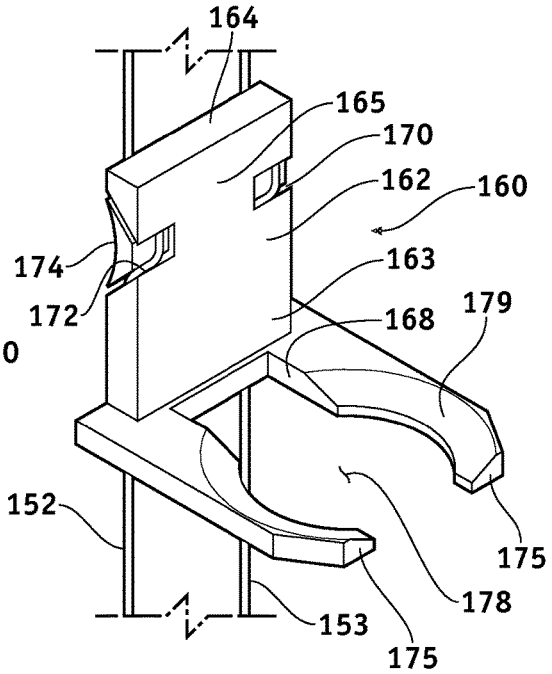
FIG. 16 is an enlarged front perspective view of a carrier member.

FIGS. 14-16 illustrate carrier members 160 of endless conveyor 114. Each carrier member 160 includes a back member 162 having a bottom edge 163, a top edge 164 a front surface 165 and a back surface 167. A fork element 168 extends perpendicularly outward from front surface 165 at bottom edge 163. Notches 170 and 172 are formed in back member 162 proximate to opposing sides and intermediate bottom edge 163 and top edge 164. Back surface 167 at notches 170 and 172 have a concave surface 173 and 174, respectively. Endless belts 152 and 153 are fed through notches 170 and 172, respectively, fixing back surface 167 of each back member 162 to endless belts 152 and 153. Back members 162 extend longitudinally with endless belts 152 and 153 and fork elements 168 are positioned at intervals transverse to the longitudinal direction of endless belts 152 and 153. The pair of endless belts 152 and 153 are employed to give stability to carrier members 160 and prevent twisting. Fork element 168 is bifurcated with partial semicircular tines 175 defining a central opening 178. Tines 175 have a top surface 179 inclined toward central opening 178. Central opening 178 and tines 175 are sized to securely nestle a ball therein.

Figure 17:
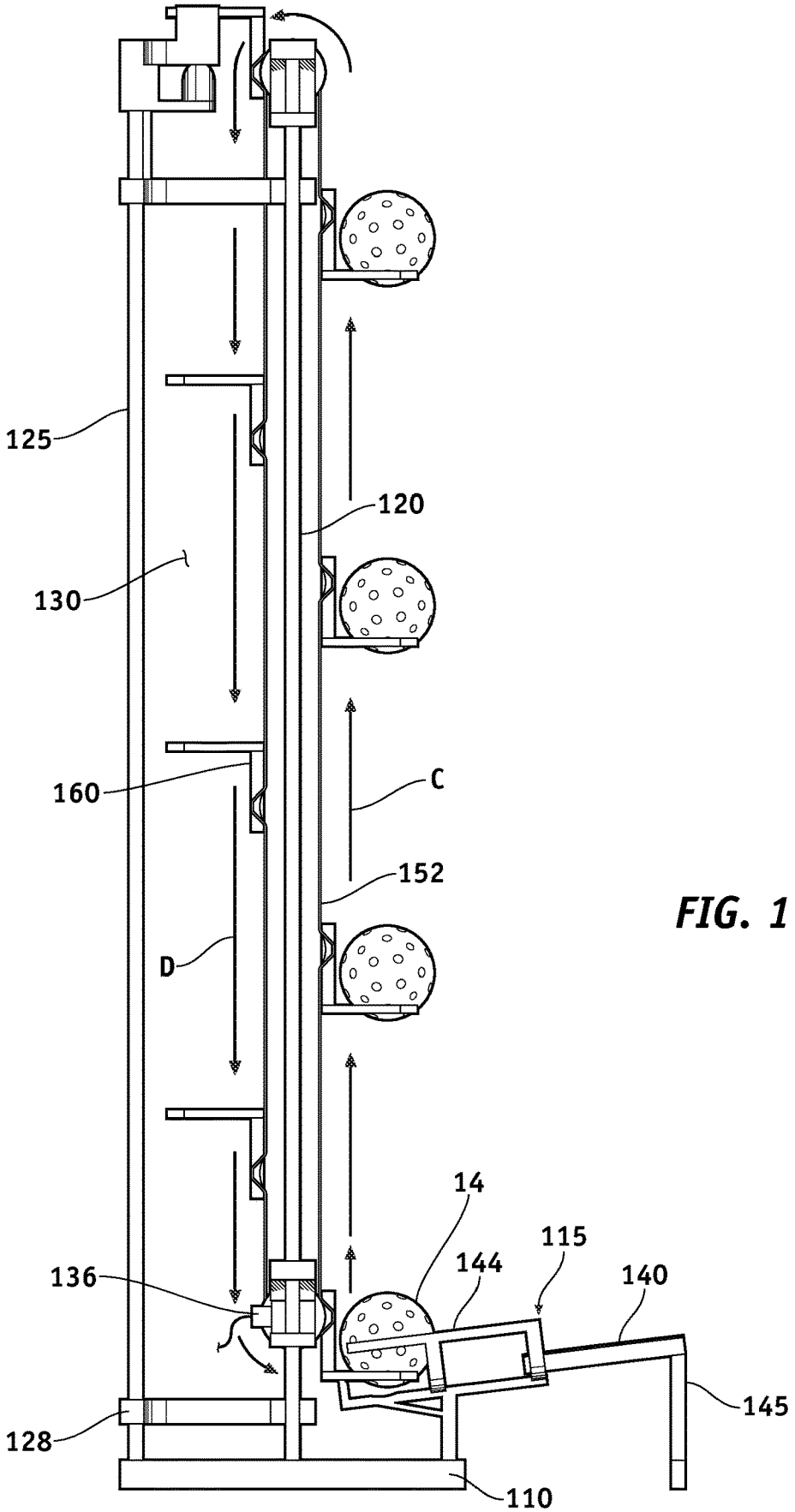
FIG. 17 is a side view of the ball elevating device in use.
Figure 18:
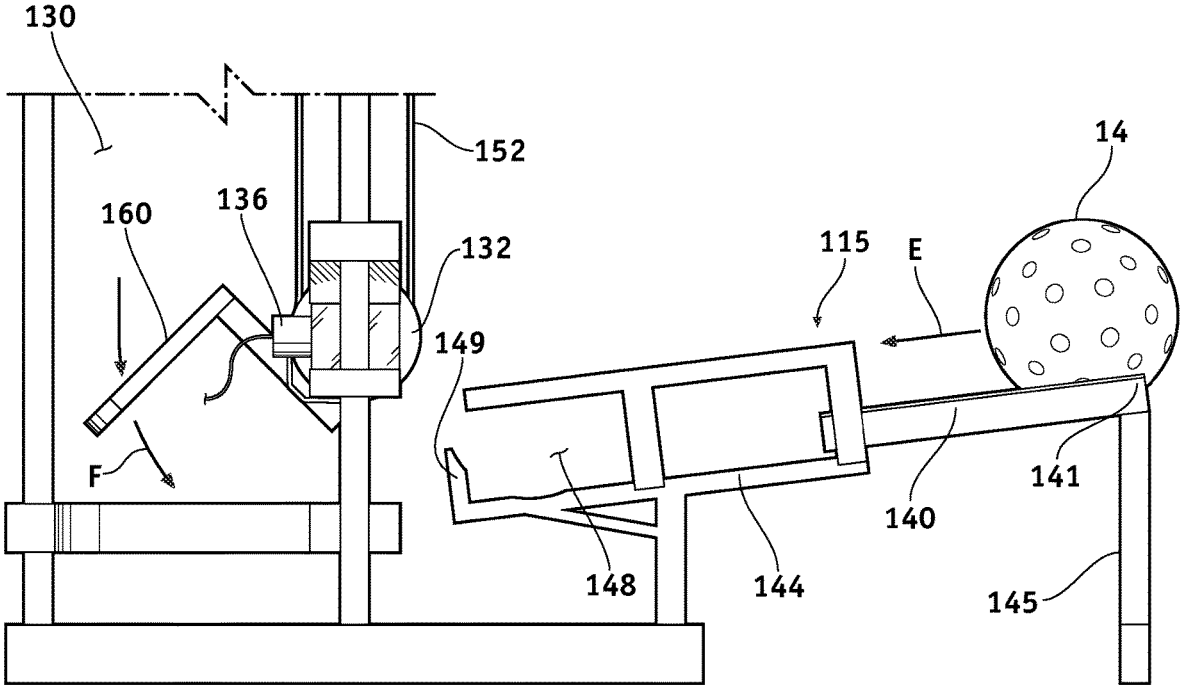
FIG. 18 is an enlarged side view of the bottom of the ball elevating device with a ball entering the feeder mechanism.
Figure 19:
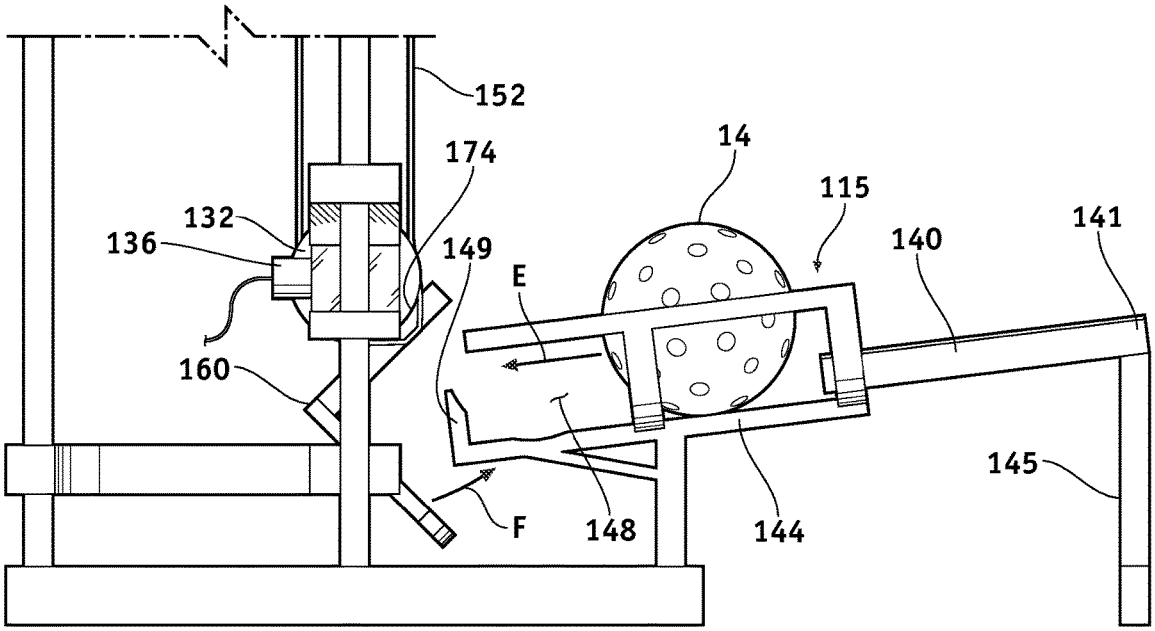
FIG. 19 is an enlarged side view of the bottom of the ball elevating device with a ball entering the positioning cradle.
Figure 20:
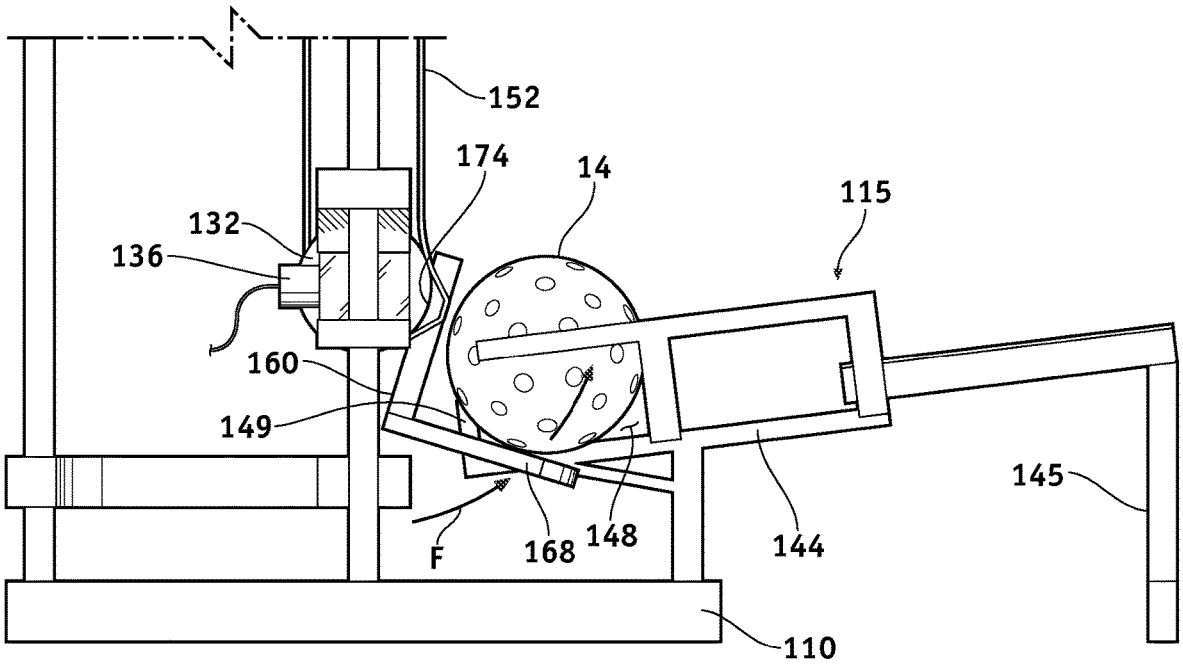
FIG. 20 is an enlarged side view of the bottom of the ball elevating device with a ball in the positioning cradle and being engaged by a carrier member.
Figure 21:
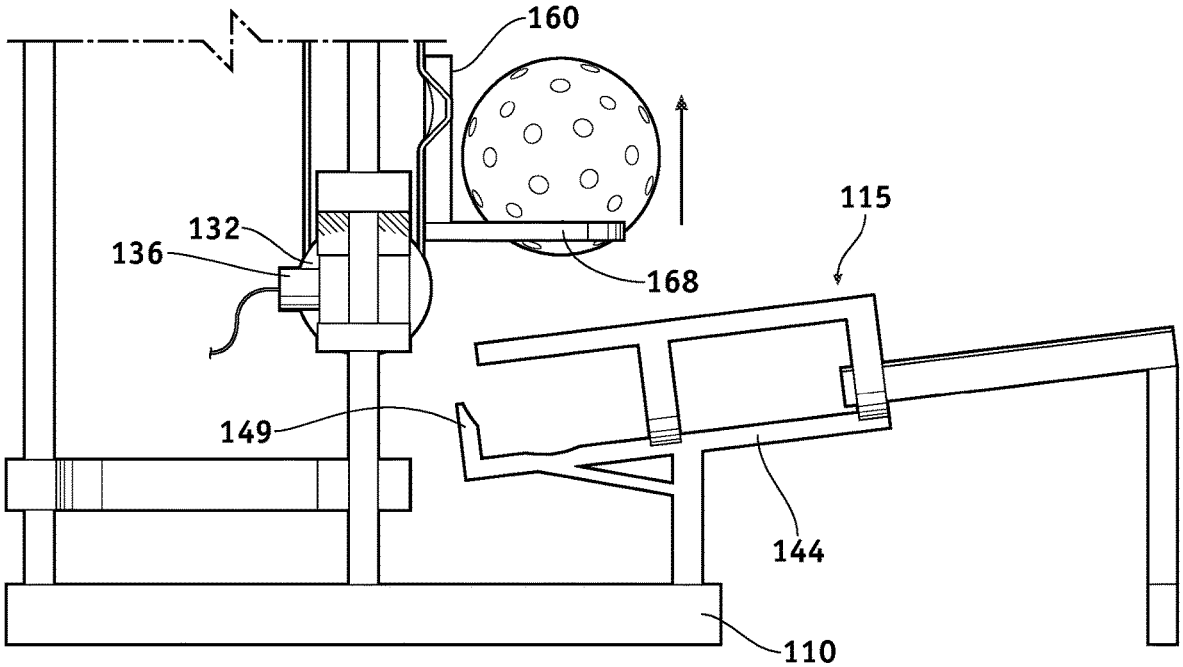
FIG. 21 is an enlarged side view of the bottom of the ball elevating device with a ball being elevated by the carrier member.

Turning to FIG. 17, device 22 is illustrated elevating balls 14 from positioning cradle 144 upwardly in the direction of arrowed lines C, disengaging each ball 14, with the inverted carrier members 160 moving downwardly within volume 130 in the direction indicated by arrowed line D. Feeder mechanism 115 is illustrated, with reference to FIGS. 18-21, loading ball 14 onto a carrier member 160. In FIG. 18, a ball 14 has been placed on high end 141 of transfer ramp 140. The slope of transfer ramp 140 causes ball 14 to roll under the influence of gravity in the direction of arrowed line E toward positioning cradle 144. An inverted carrier member 160 is concurrently moved downwardly through volume 130 by endless belts 152 and 153. As carrier member 160 reaches double spindle 132, carrier member 160 begins to rotate to an upright position aided and stabilized by concave surfaces 173 and 174 engaging double spindle 132 as indicated by arrowed lines F. In FIG. 19, ball 14 enters positioning cradle 144 and continues in the direction of arrowed line E. Carrier member 160, moving in the direction indicated by arrowed line F, moves from volume 130 through gap 135 with fork element 168 rotating upwardly under positioning cradle 144. Throughout this motion, concave surfaces 173 and 174 engage double spindle 132 providing a smooth and stable transition. FIG. 20 illustrates the movement of ball 14 in the direction of arrowed line E halted by stop member 149. With ball 14 stopped in positioning cradle 144, carrier member 160 continues moving in the direction indicated by arrowed line F, with fork element 168 rotating upwardly under positioning cradle 144 with tines 175 passing through cut-outs 147 and 148 of positioning cradle 144 and beginning to receive ball 14 within central opening 178. In FIG. 21, fork element 168 has fully engaged ball 14 with ball 14 settled in central opening 178 supported by tines 175 and being lifted from positioning cradle 144. It should be understood that fork element 168 is configured to rotate under double spindle 132 through gap 135 so as to become horizontal when tines 175 engage ball 14.

Figure 22:
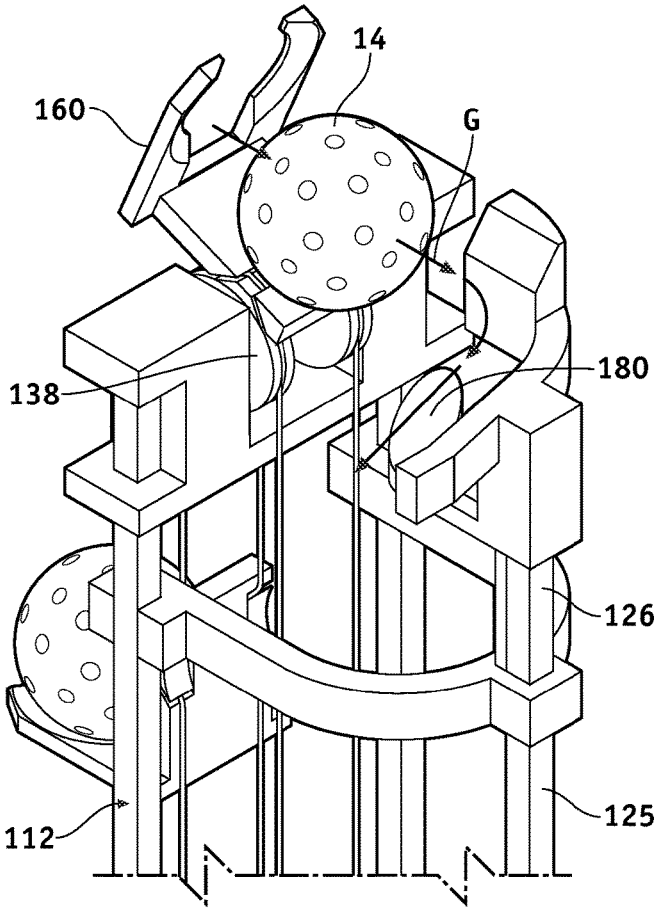
FIG. 22 is an enlarged side view of the top of the ball elevating device with a ball disengaging the carrier member.
Figure 23:
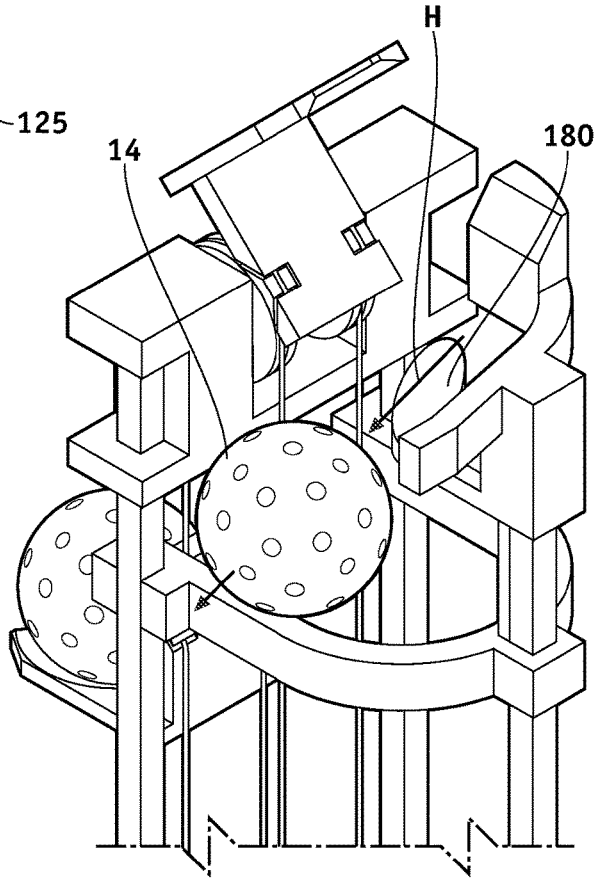
FIG. 23 is an enlarged side view of the top of the ball elevating device with a ball being redirected by a deflector element.

Referring to FIGS. 22 and 23, as carrier member 160 reaches double spindle 138 at the top of framework 112, it is inverted, disengaging ball 14 which moves in the direction indicated by arrowed line G. A deflector element 180 is carried at the top of column 125 at end 126. When ball 14 engages deflector element 180, ball 14 is redirected to the side, in the direction of arrowed line H (FIG. 23). The deflector element 180 passes between the tines 175 of carrier member 160 moving downwardly after releasing its ball 14 to the deflector element 180. The redirection of ball 14 is to direct balls 14 into a hopper of device 24. In addition to inherently strengthening or otherwise reinforcing the framework 112, the U-shaped brackets 128 and 129 shield balls from entering the volume 130 except via the feeder mechanism 115 at the bottom of the volume 130 proximate to base 110.

Figure 24:
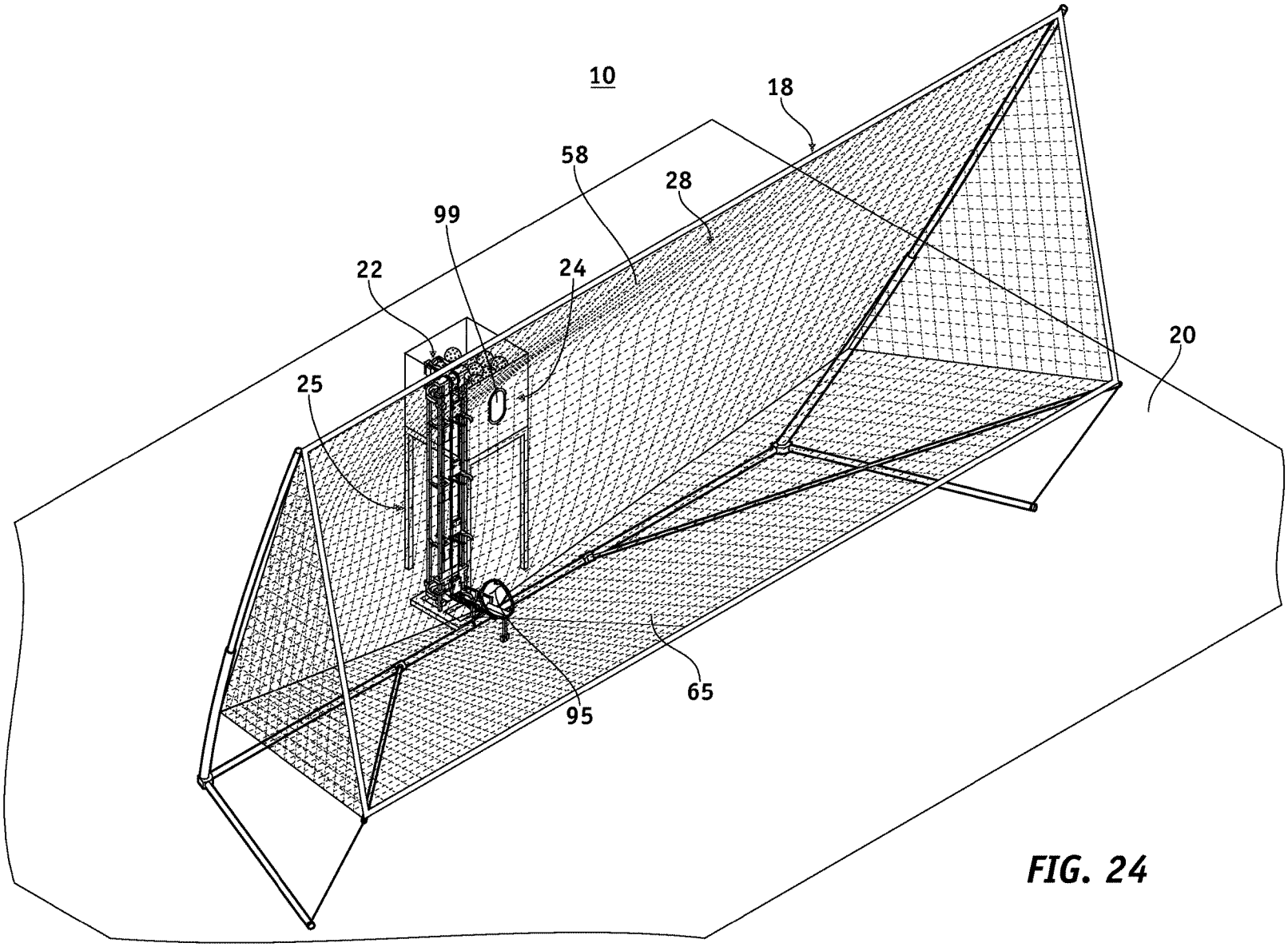
FIG. 24 is a perspective view of the ball game practice apparatus.
Figure 25:
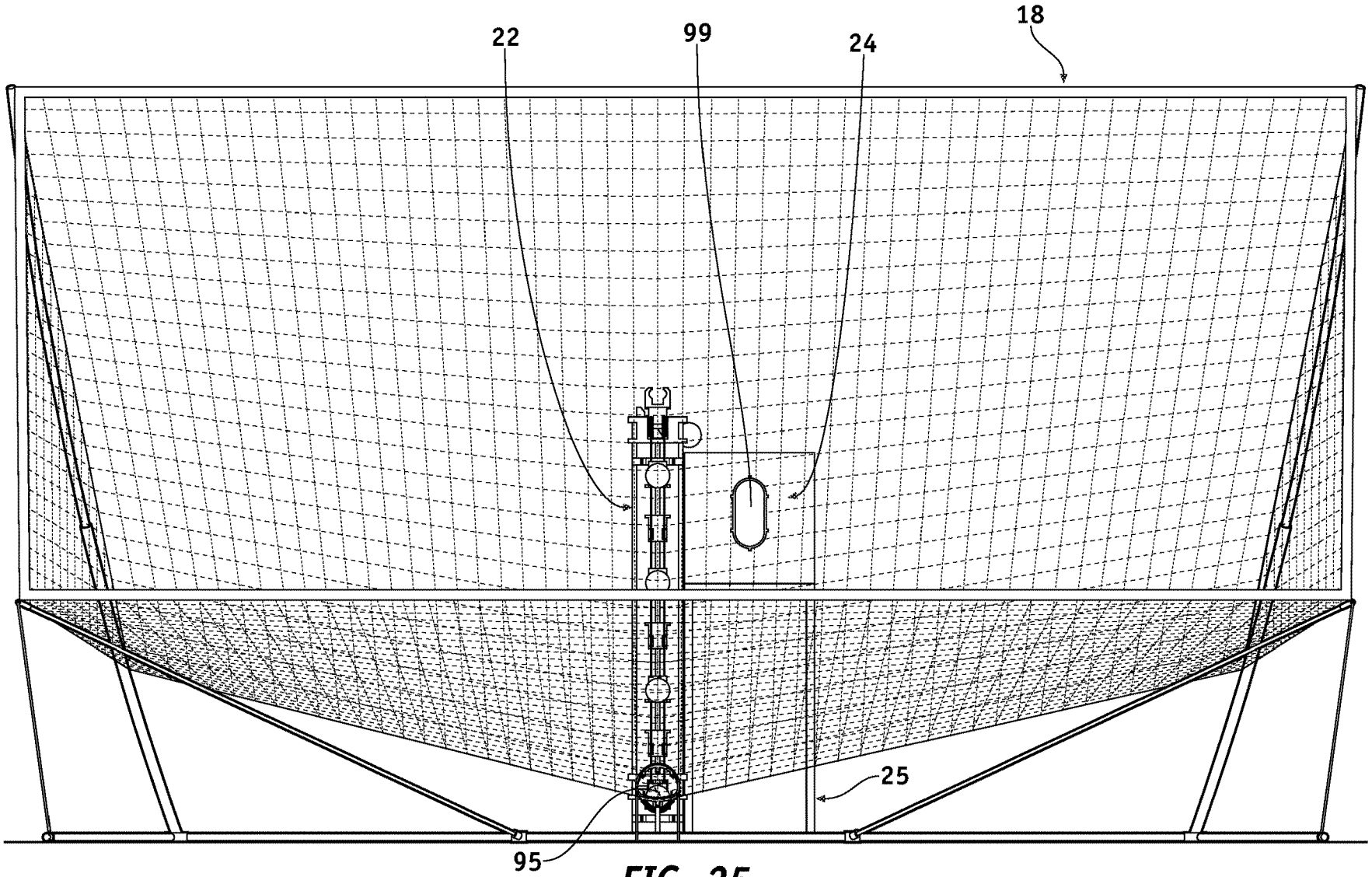
FIG. 25 is a front view of the ball game practice apparatus.
Figure 26:
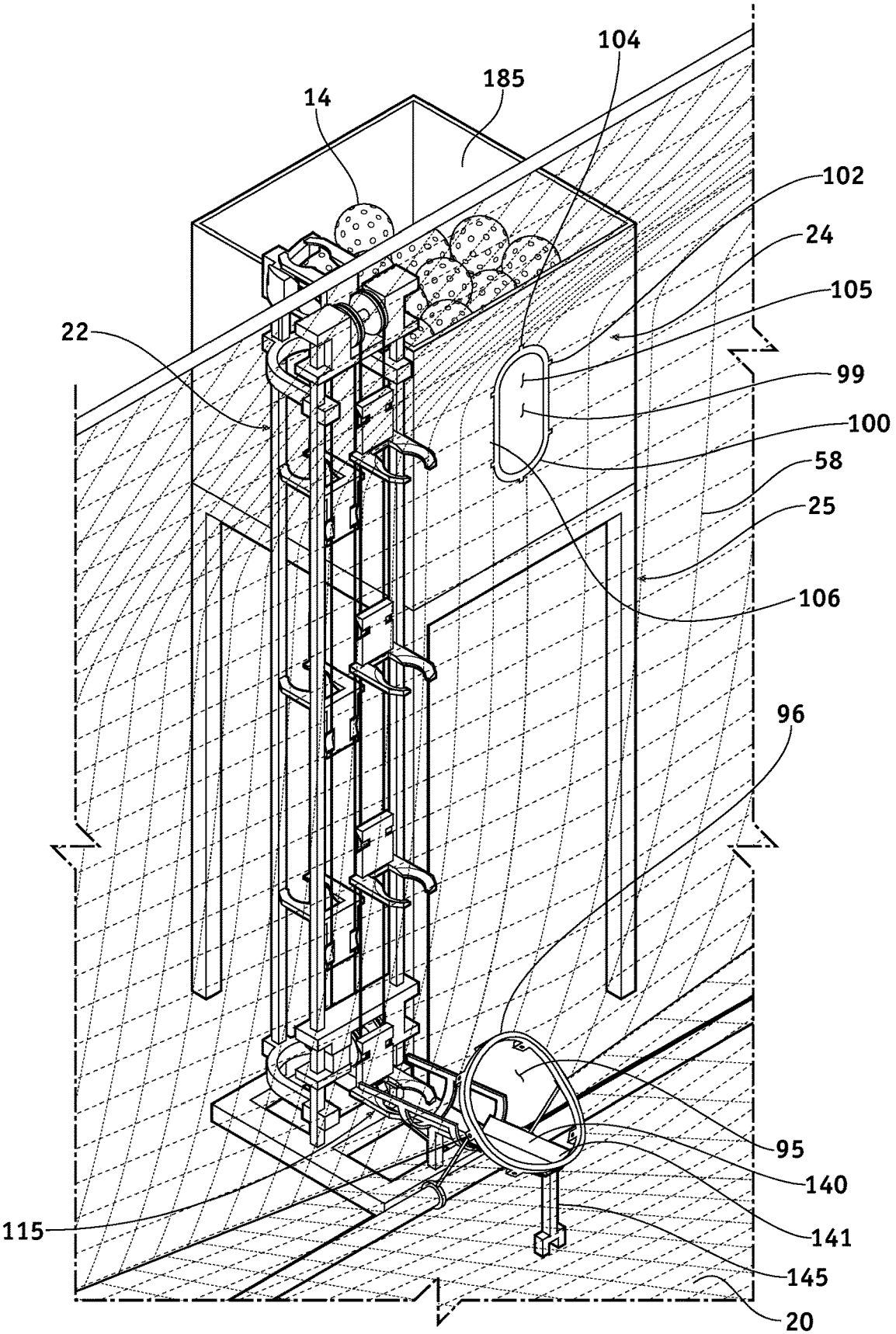
FIG. 26 is an enlarged perspective view of the ball elevating device and the ball throwing device coupled to back portion of the flexible covering.
Figure 27:
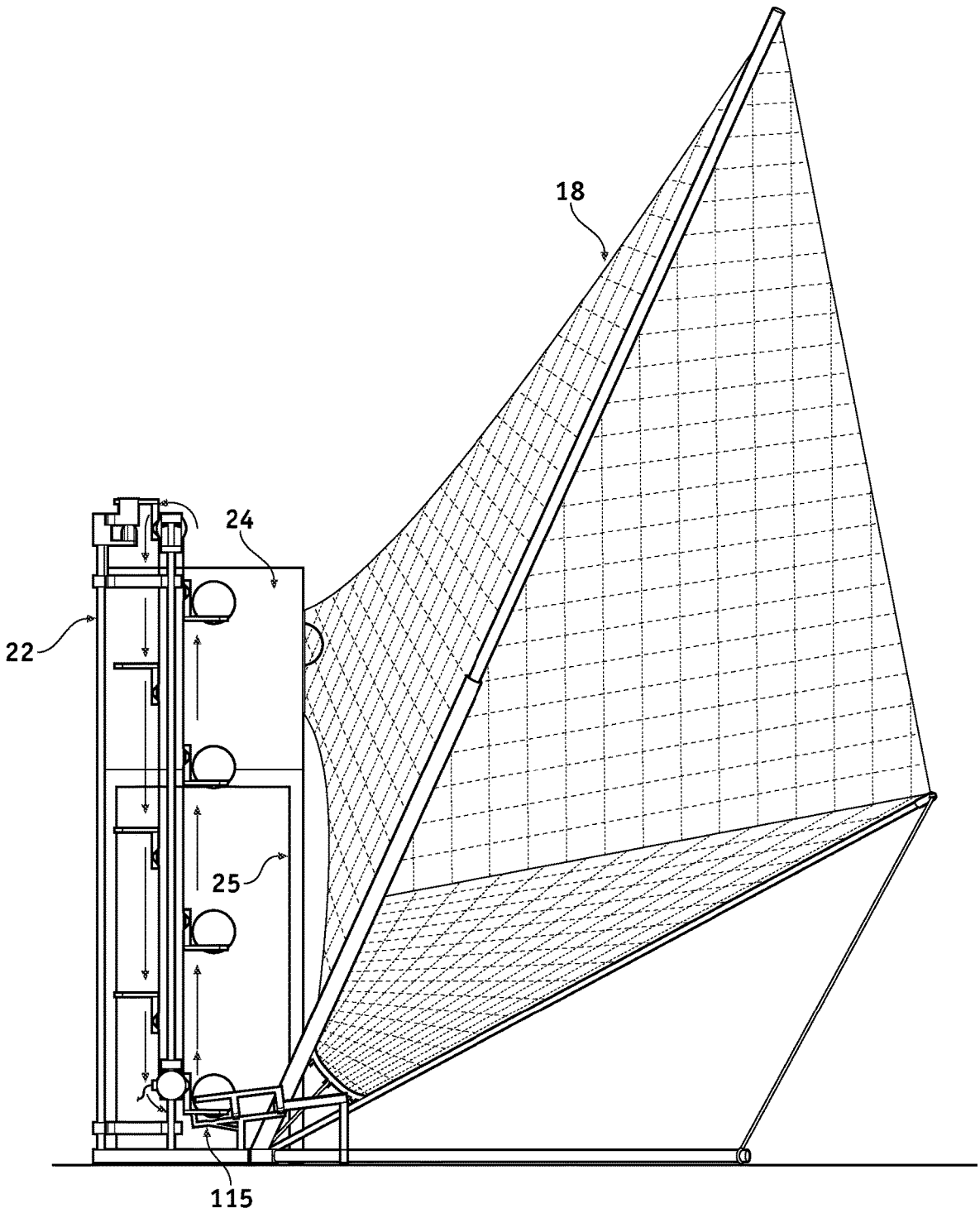
FIG. 27 is a side view of the ball elevating device and the ball throwing device coupled to the backstop assembly.

Turning to FIGS. 24 and 25, apparatus 10 is assembled with backstop assembly 18 facing forward or toward player 12 (FIG. 1). Device 22 is positioned behind back portion 58 of flexible covering 28 proximate to opening 95, with device 24 position adjacent thereto to the rear of and aligned with opening 99. With additional reference to FIGS. 26 and 27, feeder mechanism 115 is positioned so that high end 141 of transfer ramp 140 is directly under opening 95 so as to receive balls as illustrated in FIG. 18 as described previously. Opening 95 is open to transfer ramp 140, allowing the transfer ramp 140 to receive balls from opening 95. As can be seen, brace 145, which rests on surface 20, supports raised end 141 at a height compatible with the lower edge of opening 95 to allow the transfer ramp 140 to smoothly receive balls 14 from the opening 95. Device 24 is positioned at its elevated location adjacent to device 22 such that the deflection of balls 14 by deflector element 180 (FIGS. 22, 23) redirects balls 14 into hopper 185 of device 24 during operation. Opening 99 of back portion 58 is positioned so as to receive balls delivered from device 24 through its outlet 105. The arrangement of all these elements to align properly could be difficult. However, this process is simplified by fastening the back portion 58 directly to the device 24, securing the opening 99 to the outlet 105 of the device 24 (FIG. 27), thereby securing the opening 99 registered or otherwise aligned with the outlet 105. Accordingly, the back portion 58 is pulled rearwardly toward the device 24 and attached or otherwise connected directly to the device 24, securing the opening 99 registered or otherwise in alignment with the outlet 105. An engagement element 102 carried by reinforcing collar 100 is removably coupled directly to the device 24 or to a complemental engagement element 104 carried by the device 24 having a perimetric edge 106 defining the device's 24 outlet 105. Engagement element 102 and complemental engagement element 104 can be many types of fasteners, such as hook and loop fasteners, snaps ties, clips clipped to the device 24, such as over the perimetric edge 106, and the like. The engagement elements 102 can each be an adhesive tab connected adhesively to the device 24. By using reinforcing collar 100 carried by back portion 58 around the perimeter of opening 99 to securely fasten back portion 58 to device 24, back portion 58 can be manipulated to adjust for slight mispositioning of device 24. Additionally, since the opening 99 of the back portion 58 connected directly to the device 24, registering or otherwise perfectly aligning the opening 99 with the outlet 105 of device 24, it need only be large enough to allow passage of a ball therethrough from the outlet 105 of the device 24 and not so large as to easily permit unintentional passage of balls from the front. The device 24 repeatedly receives balls from the endless conveyor 114 and delivers them through backstop assembly 18, concurrently through the outlet 105 and the aligned opening 99 formed in back portion 58 attached to the device 24. During operation of the apparatus 10 in FIG. 1, the individual player 12 can for as long as he desires practice repeatedly hitting balls 14, repeatedly delivered from the apparatus 10 along arrowed line A, in a proper direction and height to mimic hitting balls during an actual racket sport game, a pickleball game in this example, on a court, a pickleball court in this example, as indicated by arrowed line B.

The present invention is described above with reference to illustrative embodiments. Those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the invention, they are intended to be included within the scope thereof.

The invention claimed is:

1. A ball game practice apparatus comprising:

a backstop assembly including a framework supporting a flexible covering, the flexible covering including a back portion and a bottom portion, the bottom portion shaped to funnel balls carried thereon to an exit opening formed therein, and the back portion having a delivery opening;

a ball elevating device including a base, a framework extending vertically from the base, an endless conveyor carried by the framework, and a feeder mechanism coupled to the endless conveyor, the feeder mechanism positioned under the exit opening of the bottom portion; and a ball throwing device having a hopper and an outlet, the hopper positioned to receive balls from the endless conveyor and deliver balls through the outlet and the delivery opening.

2. The ball game practice apparatus as claimed in claim 1, wherein the bottom portion of the flexible covering further includes an annular reinforcing member encircling the exit opening.

3. The ball game practice apparatus as claimed in claim 2, further including a pair of tensioning members, each tensioning member of the pair of tensioning members attached between an opposing side of the annular reinforcing member and the framework, pulling bottom portion downwardly to form a funnel shape centered on the exit opening.

4. The ball game practice apparatus as claimed in claim 1, further comprising the back portion attached to the ball throwing device, securing the delivery opening registered with the outlet.

5. The ball game practice apparatus as claimed in claim 1, wherein the back portion further includes a reinforcing collar encircling of the delivery opening.

6. The ball game practice apparatus as claimed in claim 5, further comprising the reinforcing collar attached to the ball throwing device, securing the delivery opening registered with the outlet.

7. The ball game practice apparatus as claimed in claim 1, wherein the endless conveyor of the ball elevating device includes:

a first double spindle rotatably carried by a first spindle bracket coupled to a bottom portion of the framework of the ball elevating device, the double spindle spaced apart from the base to form a gap therebetween;

a motor coupled to the first double spindle, the motor movable between an off configuration and an on configuration, in the on configuration, the motor rotating the first double spindle;

a second double spindle rotatably carried by a second spindle bracket coupled to a top portion of the framework of the ball elevating device;

a pair of endless belts coupled between the first double spindle and the second double spindle, the pair of endless belts moving vertically with the motor in the on configuration; and a plurality of carrier members, each carrier member of the plurality of carrier members coupled to the pair of endless belts for movement therewith.

8. The ball game practice apparatus as claimed in claim 7, wherein each carrier member of the plurality of carrier members includes a back member having a bottom edge, a fork element extending perpendicularly outwardly from the bottom edge for receiving and holding a ball, and a notch formed in each opposing side of the back member, each notch receiving one of the pair of endless belts thereby fixing the back surface thereto.

9. The ball game practice apparatus as claimed in claim 8, wherein each carrier member of the plurality of carrier members includes a concave back surface at each notch for intermittent engagement with the first double spindle and the second double spindle providing stability to each carrier member during the intermittent engagement.

10. The ball game practice apparatus as claimed in claim 8, wherein each fork element is positioned at intervals transverse to a longitudinal direction of the pair of endless belts and each fork element is bifurcated with partial semi-circular tines defining a central opening sized to securely nestle a ball therein.

11. The ball game practice apparatus as claimed in claim 1, further including a deflector element carried at the top of the framework of the ball elevating device, the deflector element positioned to engage balls and redirected them to the side and into the hopper of the ball throwing device.

12. A ball game practice apparatus comprising:

a backstop assembly including a framework supporting a flexible covering, the flexible covering including a back portion and a bottom portion, the bottom portion shaped to funnel balls carried thereon to an exit opening formed therein, and the back portion having a delivery opening;

a ball elevating device including a base, a framework extending vertically from the base, an endless conveyor carried by the framework, and a feeder mechanism coupled to the endless conveyor, the feeder mechanism positioned under the exit opening of the bottom portion;

a ball throwing device having a hopper and an outlet, the hopper positioned to receive balls from the endless conveyor and deliver balls through the outlet and the delivery opening; and the back portion of the flexible covering coupled to the ball throwing machine, securing the delivery opening registered with the outlet.

13. The ball game practice apparatus as claimed in claim 12, further comprising the back portion including a reinforcing collar encircling the delivery opening, the reinforcing collar coupled to the ball throwing machine, securing the delivery opening registered with the outlet.

14. The ball game practice apparatus as claimed in claim 12, wherein the bottom portion of the flexible covering further includes an annular reinforcing encircling the exit opening.

15. The ball game practice apparatus as claimed in claim 14, further including a pair of tensioning members, each tensioning member of the pair of tensioning members attached between an opposing side of the annular reinforcing member and the framework, pulling bottom portion downwardly to form a funnel shape centered on the exit opening.

16. The ball game practice apparatus as claimed in claim 12, wherein the endless conveyor of the ball elevating device includes:

a first spindle rotatably carried by a first spindle bracket coupled to a bottom portion of the framework of the ball elevating device, the spindle spaced apart from the base to form a gap therebetween;

a motor coupled to the first spindle, the motor movable between an off configuration and an on configuration, in the on configuration, the motor rotating the first spindle;

a second spindle rotatably carried by a second spindle bracket coupled to a top portion of the framework of the ball elevating device;

an endless belt coupled between the first spindle and the second spindle, the endless belt moving vertically with the motor in the on configuration; and a plurality of carrier members, each carrier member of the plurality of carrier members coupled to the endless belt for movement therewith.

17. The ball game practice apparatus as claimed in claim 16, wherein the first spindle is a first double spindle, the second spindle is a second double spindle, and the endless belt is a pair of endless coupled between the first double spindle and the second double spindle.

18. The ball game practice apparatus as claimed in claim 17, wherein each carrier member of the plurality of carrier members includes a back member having a bottom edge, a fork element extending perpendicularly outwardly from the bottom edge for receiving and holding a ball, and a notch formed in each opposing side of the back member, each notch receiving one of the pair of endless belts thereby fixing the back surface thereto.

19. The ball game practice apparatus as claimed in claim 18, wherein each fork element is positioned at intervals transverse to a longitudinal direction of the pair of endless belts and each fork element is bifurcated with partial semi-circular tines defining a central opening sized to securely nestle a ball therein.

20. The ball game practice apparatus as claimed in claim 12, further including a deflector element carried at the top of the framework of the ball elevating device, the deflector element positioned to engage balls and redirected them to the side and into the hopper of the ball throwing device.

* * * * *